US009706892B2

(12) United States Patent
Kanai

(10) Patent No.: US 9,706,892 B2
(45) Date of Patent: Jul. 18, 2017

(54) ADHESIVE ROLLER-TYPE CLEANING TOOL

(71) Applicant: Tomio Kanai, Tokyo (JP)

(72) Inventor: Tomio Kanai, Tokyo (JP)

( * ) Notice: Subject to any disclaimer, the term of this patent is extended or adjusted under 35 U.S.C. 154(b) by 142 days.

(21) Appl. No.: 14/432,507

(22) PCT Filed: Oct. 10, 2013

(86) PCT No.: PCT/JP2013/077568
§ 371 (c)(1),
(2) Date: Jul. 15, 2015

(87) PCT Pub. No.: WO2014/058006
PCT Pub. Date: Apr. 17, 2014

(65) Prior Publication Data

US 2015/0313443 A1 Nov. 5, 2015

(30) Foreign Application Priority Data

Oct. 10, 2012 (JP) ..... 2012-224746

(51) Int. Cl.
*A47L 11/28* (2006.01)
*A47L 11/33* (2006.01)
(Continued)

(52) U.S. Cl.
CPC ..... *A47L 11/4047* (2013.01); *A47L 11/4069* (2013.01); *A47L 25/005* (2013.01); *A47L 13/38* (2013.01); *A47L 25/00* (2013.01)

(58) Field of Classification Search
CPC ..... A47L 13/38; A47L 25/005; A47L 25/00; A47L 11/4069; A47L 11/4047
(Continued)

(56) References Cited

U.S. PATENT DOCUMENTS 1,169,333 A * 1/1916 McDonald ..... B65H 20/18 226/115
5,499,877 A * 3/1996 Sakanishi ..... B65H 37/007 400/193
(Continued)

FOREIGN PATENT DOCUMENTS

JP H07-16198 A 1/1995
JP H11-169333 A 6/1999
(Continued)

*Primary Examiner* — Michael Jennings
(74) *Attorney, Agent, or Firm* — Im IP Law; C. Andrew Im

(57) ABSTRACT

A rotatably installed adhesive roller unit and a take-up unit to wind up the adhesive sheet after being drawn out of the adhesive roller unit and having lint adhered thereon. The take-up unit is installed to be configured to rotate forward and backward synchronized through a rotation transmission unit with forward and backward rotation of the adhesive roller unit. The adhesive roller unit engages the rotation transmission unit when pressed onto a contact surface and moved forward. The adhesive roller unit is energized to release the engagement with the rotation transmission unit when moved backward and separated from the contact surface. A rotation inhibiting mechanism is provided to inhibit the rotation of both the adhesive roller unit and the take-up unit when the adhesive roller unit separates from the contact surface.

4 Claims, 13 Drawing Sheets

(51) Int. Cl.
*A47L 25/00* (2006.01)
*A47L 11/40* (2006.01)
*A47L 13/38* (2006.01)

(58) Field of Classification Search
USPC ..... 15/3, 98, 104.002, 231
See application file for complete search history.

(56) References Cited

U.S. PATENT DOCUMENTS 6,343,397 B1 * 2/2002 Odagiri ..... A47L 25/005 15/104.002
8,910,340 B2 * 12/2014 Bradbury ..... A47L 11/33 15/210.1
2002/0023666 A1 * 2/2002 Tawara ..... A47L 11/22 134/6
2003/0159223 A1 * 8/2003 Plankenhorn ..... A47L 11/22 15/52.1
2006/0254017 A1 * 11/2006 Knopow ..... B08B 7/0028 15/250.22
2006/0265824 A1 * 11/2006 Knopow ..... A47L 11/33 15/27
2009/0097902 A1 * 4/2009 Lemmon ..... A47L 11/26 401/140
2011/0078866 A1 * 4/2011 Panthofer ..... A47L 25/005 15/104.002
2011/0146011 A1 * 6/2011 Day ..... A47L 25/005 15/104.002
2011/0247651 A1 * 10/2011 Neumann ..... A47L 11/33 134/6
2012/0061026 A1 * 3/2012 Lu ..... A47L 25/005 156/510
2013/0333129 A1 * 12/2013 Bradbury ..... A47L 11/33 15/105
2016/0278594 A1 * 9/2016 Bradbury ..... A47L 11/33

FOREIGN PATENT DOCUMENTS

JP 2000-202 A 1/2000
JP 2002-078664 A 3/2002
JP 2005-131360 A 5/2005
JP 2008-168107 A 7/2008
JP 2009-28228 A 2/2009

* cited by examiner

ADHESIVE ROLLER-TYPE CLEANING TOOL

RELATED APPLICATION

This application is a §371 application from PCT/JP2013/077568 filed Oct. 10, 2013, which claims priority from Japanese Patent Application No. 2012-224746 filed Oct. 10, 2012, each of which is herein incorporated by reference in its entirety

TECHNICAL FIELD

The present invention relates to an adhesive roller-type cleaning tool, namely, a cleaning tool that removes hair, lint and the like that has fallen onto a carpet or quilt, for example, by adhesion to an adhesive roll.

BACKGROUND OF THE INVENTION

The conventional adhesive roller-type cleaning tool of this type consists of an adhesive roller unit constituted by winding an adhesive sheet of a certain length into a drum shape, a case unit (support unit) for rotatably supporting the adhesive roller unit, and a grip unit connected to the case unit integrally or as a separate body.

The booming popularity of pets in recent years has led to countless dogs, cats and other companion animals being kept in the house, and this in turn has led to the appearance of unsightly pet hairs, lint, mite- and tick-remains and the like on room floors, sofas, bedding and elsewhere in many homes.

Particularly at the time of seasonal changes, when hair fallout increases and needs to be collected and disposed of together with lint, dead mites and the like, this type of adhesive roller-type cleaning tool is very handy and it is no exaggeration to say that at least one can be found in every home.

This type of adhesive roller-type cleaning tool is used as follows.

First, the adhesive sheet (adhesive surface) of the adhesive roll is pressed onto the floor where the pet hairs and lint is.

Then the grip unit is pushed forward, whereupon at the stage of one revolution, hair, lint and the like are adhered to the adhesive sheet. This operation is repeated until the adhesive force has diminished, at which stage the portion of the adhesive sheet covered with hair and lint is torn off and thrown away.

With this conventional technique, it has been necessary to tear off the portion of the adhesive sheet covered with adhered hair and lint every time the adhesive force of the adhesive sheet becomes weak. This work is very troublesome because it has to be performed again and again. This bothersome work is even more unbearable because it involves the additional task of finding the leading end of the adhesive sheet midst the accumulated hair and lint.

Moreover, when the adhesive sheet with much adhered hair and lint is to be torn off by hand, one hesitates because it involves touching the hair and lint and is by no means sanitary.

This led to the disclosure of the prior art set out in Patent Documents 1 to 3 with the aim of supplying a clean adhesive sheet without need to tear off a portion of the adhesive sheet covered with adhered hair, lint and the like, thereby improving workability and offering improvement from the hygienic aspect.

PRIOR ART DOCUMENTS

Patent Documents

Patent Document 1:
Japanese Patent Publication (A) No. H07-16198
Patent Document 2
Japanese Patent Publication (A) No. H11-169333
Patent Document 3
Japanese Patent Publication (A) No. 2002-78664

OBJECT AND SUMMARY OF THE INVENTION

Problem to be Overcome by the Invention

The prior art examples taught by Patent Documents 1 to 3 are constituted by providing an adhesive roller unit formed by winding up an adhesive sheet, and a take-up unit for taking up used adhesive sheet, which units are both rotatably installed in a case.

In the structures of Patent Documents 1 and 2, a predetermined length of adhesive sheet is drawn out from the adhesive roller unit, the leading end thereof is fastened to the take-up unit, and the adhesive roller unit is contacted with the surface to be cleaned. When the adhesive surface becomes covered with hair and lint and it is presumed that the adhesive force has weakened, the take-up unit is manually rotated to take up the used adhesive sheet.

Therefore, since the used adhesive sheet is wound up by the take-up unit, the user does not need to make direct hand contact by tearing off the used adhesive sheet with attached hair and lint in order to draw out a new adhesive sheet, which is sanitary and also offers excellent ease of use.

However, the adhesive roller-type cleaning tools disclosed in Patent Documents 1 and 2 do not overcome the following problem.

Specifically, when, in the course of use, the adhesive surface of the adhesive sheet becomes completely covered with hair and lint and its adhesive force weakens, the user must once stop working (cleaning) and perform the separate bothersome work of manually rotating the take-up unit to take up used adhesive sheet and draw out new adhesive sheet.

Patent Document 3, which overcomes this inconvenience of Patent Documents 1 and 2, has a structure that operates a take-up unit to automatically take up used adhesive sheet drawn out from the adhesive roller unit and covered with adhered hair and lint after use.

If the structure disclosed in Patent Document 3 is adopted, the bother is eliminated of the user having to once stop working (cleaning) and perform the separate work of manually rotating the take-up unit to take up used adhesive sheet and draw out new adhesive sheet.

However, the adhesive roller-type cleaning tool disclosed in Patent Document 3 also has an unsolved issue.

Specifically, this type of adhesive roller-type cleaning tool has a drawback in that when the adhesive sheet contacts a flooring or other type floor surface, it sticks to the floor surface owing to its adhesive force and is pulled out when moved or lifted in that condition.

In the configuration according to the technical concept disclosed in Patent Document 3, arms with reverse rotation preventing pawls are engaged with gears of both the adhesive roller unit and the take-up unit to prevent rotation in other than a predetermined direction (prevent reverse rotation), but rotation in the predetermined direction (normal rotation) is not restricted other than during use, so that movement or lifting in a state with the adhesive sheet stuck to a floor surface causes sudden rotation of the adhesive roller or take-up unit and makes it impossible to avoid the inconvenience of the adhesive sheet being pulled out. Moreover, overcoming such a problem is not suggested as an objective.

The present invention was accomplished in light of these issues of the prior art and has as its object to provide an adhesive roller-type cleaning tool that can successively supply clean adhesive sheet without need to tear away a portion of the adhesive sheet covered with adhered hair, lint or the like, thereby restraining unintentional withdrawal of adhesive sheet while improving workability and enhancing sanitation.

Means for Solving the Problem

The technical means accomplished by a first embodiment of the invention for achieving this object is an adhesive roller-type cleaning tool characterized in comprising:

a case member, an adhesive roller unit deployed inside the case member to be rotatable forward and backward; and a take-up unit for winding up adhesive sheet after being drawn out of the adhesive roller unit and having lint and the like adhered thereon, wherein, the take-up unit is capable of forward and backward rotation synchronized through a rotation transmission unit with forward and backward rotation of the adhesive roller unit, and the adhesive roller unit engages the rotation transmission unit when pressed onto a contact surface and moved forward and is energized to release the engagement with the rotation transmission unit when moved backward and when separated from the contact surface; and further comprising:

a rotation inhibiting mechanism for inhibiting rotation of both the adhesive roller unit and the take-up unit when the adhesive roller unit separates from the contact surface.

According to this embodiment of the invention, the take-up unit is provided to be capable of forward and backward rotation synchronized through the rotation transmission unit with forward and backward rotation of the adhesive roller unit, so that adhesive sheet drawn out by rotation of the adhesive roller unit is successively wound up on the take-up unit synchronously with the rotation of the adhesive roller unit.

Further, a configuration is adopted whereby the adhesive roller unit engages the rotation transmission unit when pressed onto a contact surface and moved forward and is energized to release the engagement with the rotation transmission unit when moved backward and when separated from the contact surface, so that rotation of the adhesive roller unit is transmitted to the take-up unit to wind up adhesive sheet when pressed onto a floor surface and moved forward but the adhesive roller unit is put in a free rotating state (state free to rotate forward or backward) owing to release of the engagement of the adhesive roller unit with the rotation transmission unit when rotated in the opposite direction, i.e., when rotated in reverse (rearward) to draw the adhesive roller unit nearer the user.

Therefore, load-free operation is possible when pushing/pulling the adhesive roller unit forward or backward.

In addition, a rotation inhibiting mechanism is provided for inhibiting rotation of both the adhesive roller unit and the take-up unit when the adhesive roller unit separates from the contact surface, so that even if the adhesive sheet should inseparably stick to a floor surface, unintentional withdrawal of adhesive sheet is restrained because rotation of both the adhesive roll and the take-up unit is inhibited.

A second embodiment of the invention is characterized in that the adhesive roller-type cleaning tool according to the first embodiment of the invention, further comprises:

a grip unit connected to be rotatable forward and backward with respect to the case member, grip unit is energized to linearly align with the case member and is rotated forward against the energizing force when the adhesive roller unit is pressed onto the contact surface.

According to this embodiment of the invention, when, for example, a user in a standing posture presses the adhesive roller unit toward a floor surface, this pressing action can be used to rotate the grip unit forward against the energizing force, i.e., to rotate the grip unit relative to the case unit to a given angle from the linear alignment.

A third embodiment of the invention is characterized in that in the adhesive roller-type cleaning tool according to the second embodiment of the invention, the rotation inhibiting mechanism is synchronized with the forward and rearward rotation of the grip unit to inhibit rotation of the adhesive roller unit and the take-up unit when the grip unit is linearly aligned with the case member by the energizing force and to release the inhibiting action when the adhesive roller unit is pressed onto a contact surface against the energizing force.

According to this embodiment of the invention, rotation of the adhesive roll and the take-up unit is inhibited by the rotation inhibiting mechanism when the grip unit is linearly aligned with the case member by the energizing force, so that unintentional withdrawal of adhesive sheet is restrained even if the adhesive roller-type cleaning tool is raised during movement to another location or after cleaning is completed.

A downward force is inevitably applied when the adhesive roller-type cleaning tool of this embodiment of the invention is used for cleaning, meaning that ease-of-use is excellent because the rotation inhibiting mechanism comes to be released by a pushing force that overcomes the energizing force.

The fourth embodiment of the invention is an adhesive roller-type cleaning tool characterized in comprising:

an adhesive roller unit deployed to be rotatable forward and backward; and a take-up unit for winding up adhesive sheet after being drawn out of the adhesive roller unit and having lint and the like adhered thereon, wherein, the take-up unit is capable of forward and backward rotation synchronized through a rotation transmission unit with forward and backward rotation of the adhesive roller unit, and the adhesive roller unit engages the rotation transmission unit when pressed onto a contact surface and moved forward and is energized to release the engagement with the rotation transmission unit when moved backward and when separated from the contact surface; and further comprising:

a rotation inhibiting mechanism for inhibiting rotation of both the adhesive roller unit and the take-up unit when the adhesive roller unit separates from the contact surface.

According to this embodiment of the invention, as in the first embodiment of the invention, the take-up unit is provided to be capable of forward and backward rotation synchronized through the rotation transmission unit with forward and backward rotation of the adhesive roller unit, so that adhesive sheet drawn out by rotation of the adhesive roller unit is successively wound up on the take-up unit synchronously with the rotation of the adhesive roller unit.

Further, a configuration is adopted whereby the adhesive roller unit engages the rotation transmission unit when pressed onto a contact surface and moved forward and is energized to release the engagement with the rotation transmission unit when moved backward and when separated from the contact surface, so that rotation of the adhesive roller unit is transmitted to the take-up unit to wind up adhesive sheet when pressed onto a floor surface and moved forward but the adhesive roller unit is put in a free rotating state (state free to rotate forward or backward) owing to release of the engagement of the adhesive roller unit with the rotation transmission unit when rotated in the opposite direction, i.e., when rotated backward (in reverse) to draw the adhesive roller unit nearer the user.

Therefore, load-free operation is possible when pushing/pulling the adhesive roller unit forward or backward.

In addition, a rotation inhibiting mechanism is provided for inhibiting rotation of both the adhesive roller unit and the take-up unit when the adhesive roller unit separates from the contact surface, so that even if the adhesive sheet should inseparably stick to a floor surface, unintentional withdrawal of adhesive sheet is restrained because rotation of both the adhesive roll and the take-up unit is inhibited.

A fifth embodiment of the invention is characterized in that the adhesive roller-type cleaning tool according to the fourth embodiment of the invention further comprises a grip unit, the adhesive roller unit and the take-up unit are each integrally equipped with an engaging unit, and the rotation inhibiting mechanism is equipped with inhibiting units that operate in coordination with push-down/pull-up action of the grip unit to lock with or unlock from the respective engaging units.

According to this embodiment of the invention, the inhibiting units of the rotation inhibiting mechanism operate in coordination with push-down/pull-up action of the grip unit to lock with the engaging unit of the adhesive roller unit and the engaging unit of the take-up unit respectively to inhibit rotation of the adhesive roller unit and the take-up unit. Therefore, unintentional withdrawal of adhesive sheet is restrained even if the adhesive roller-type cleaning tool is raised during movement to another location or after cleaning is completed.

A downward force is inevitably applied when the adhesive roller-type cleaning tool of this invention is used for cleaning, meaning that ease-of-use is excellent because the locking of the inhibiting units with the engaging units is released when the adhesive roller unit is pressed onto a floor surface or the like by a push-down action of the grip unit.

A sixth embodiment of the invention is characterized in that the adhesive roller-type cleaning tool according to the fifth embodiment of the invention further comprises a case member, which case member is provided on an inner face with a handle base plate installed to be vertically moveable, and a handle plate rotatably journaled on the handle base plate at one end and vertically moveable with the handle base plate, one end of the grip unit being connected to the handle plate, the adhesive roller unit and the take-up unit being arranged vertically in parallel by means of an adhesive roller unit rotary shaft and a take-up unit rotary shaft both of which project outward of the case member, the adhesive roller unit rotary shaft and the take-up unit rotary shaft each having one end housed inside the case member, a first gear and a first engaging unit being integrally provided on the one end of the adhesive roller unit rotary shaft, a second gear and a second engaging unit being integrally provided on the one end of the take-up unit rotary shaft, the rotation transmission unit being constituted of a third gear and a fourth gear deployed inside the case member between the first gear and the second gear, the third gear being constantly meshed with the second gear, the fourth gear being rotatably retained on a gear retaining plate whose one end is rotatably journaled on the inner face of the case member, which gear retaining plate is constantly energized to separate the fourth gear from the first gear, the handle base plate being provided with inhibiting units respectively engageable with the first engaging unit and the second engaging unit, and the handle plate having a pressing portion, which pressing portion is caused by a press-down action of the grip unit to press the gear retaining plate and enable the fourth gear to engage with the first gear and the third gear.

According to this embodiment of the invention, when the adhesive roller unit is pressed onto a floor surface or the like by a press-down action of the grip unit, the locked state of the inhibiting units of the handle base plate engaged with the first engaging unit and the second engaging unit is unlocked to put the adhesive roller unit and the take-up unit in a forward and backward rotatable state.

Then the push-down action of the grip unit presses down the handle plate together with the handle base plate and rotates it around a bearing, whereby the pressing portion provided on the handle plate presses the gear retaining plate.

Upon application of the pressing force by the pressing portion, the gear retaining plate rotates around the bearing, whereby the fourth gear provided on the gear retaining plate moves between the first gear and third gear and engages with these gears. As a result, the first gear provided on the adhesive roller unit side and the second gear provided on the take-up unit side engage and synchronize through the rotation transmission unit comprising the third gear and the fourth gear thereby rotating the take-up unit forward and backward in synchronism with forward and backward rotation of the adhesive roller unit, so that adhesive sheet drawn out by rotation of the adhesive roller unit is successively wound up by the take-up unit synchronized with the rotation of the adhesive roller unit.

Further, the adhesive roller unit engages the rotation transmission unit when pressed onto a contact surface and moved forward, and separates from the fourth gear and the first gear when moved backward or separated from a floor or the like, because the grip unit applies no press-down force on the handle plate and the pressing force on the gear retaining plate is also released, i.e., the rotation transmission unit is disengaged, so that although the rotation of the adhesive roller unit is transmitted to the take-up unit to wind up adhesive sheet during pressing onto a floor surface together with forward movement, the adhesive roller unit is put in a free rotating state (state free to rotate forward or backward) owing to release of the engagement of the adhesive roller unit with the rotation transmission unit when rotated in the opposite direction, i.e., when rotated backward (in reverse) to draw the adhesive roller unit nearer the user.

Therefore, load-free operation is possible when pushing/pulling the adhesive roller unit forward or backward.

In addition, the rotation inhibiting mechanism (inhibiting units) is provided for inhibiting rotation of both the adhesive roller unit and the take-up unit and the inhibiting units engage and lock the first engaging unit provided on the adhesive roller unit side and the second engaging unit provided on the take-up unit side when the adhesive roller unit separates from a floor surface or the like, so that even if the adhesive sheet should inseparably stick to a floor surface, unintentional withdrawal of adhesive sheet is restrained because rotation of both the adhesive roll and the take-up unit is inhibited.

Effect of the Invention

The present invention provides an adhesive roller-type cleaning tool that can successively supply clean adhesive sheet without need to tear away a portion of the adhesive sheet covered with adhered hair, lint or the like, and can restrain unintentional withdrawal of adhesive sheet, while improving workability and enhancing sanitation.

DETAILED DESCRIPTION OF THE EMBODIMENTS

Embodiments of the adhesive roller-type cleaning tool according to the present invention are explained below with reference to the attached drawings.

FIG. 1 to FIG. 6 show a first embodiment of the present invention, and FIG. 7 to FIG. 13 show a second embodiment of the present invention.

The following embodiments explained based on the attached drawings merely exemplify specific modes of working the present invention and are not to be construed as limitative in any way but can be suitably modified within the scope of the present invention. The adhesive roller-type cleaning tool of the present invention is adaptable for both home and commercial use and can be suitably modified in design in accordance with the desired purpose without limitation regarding size, materials and other aspects.

First Embodiment

Figure 1:
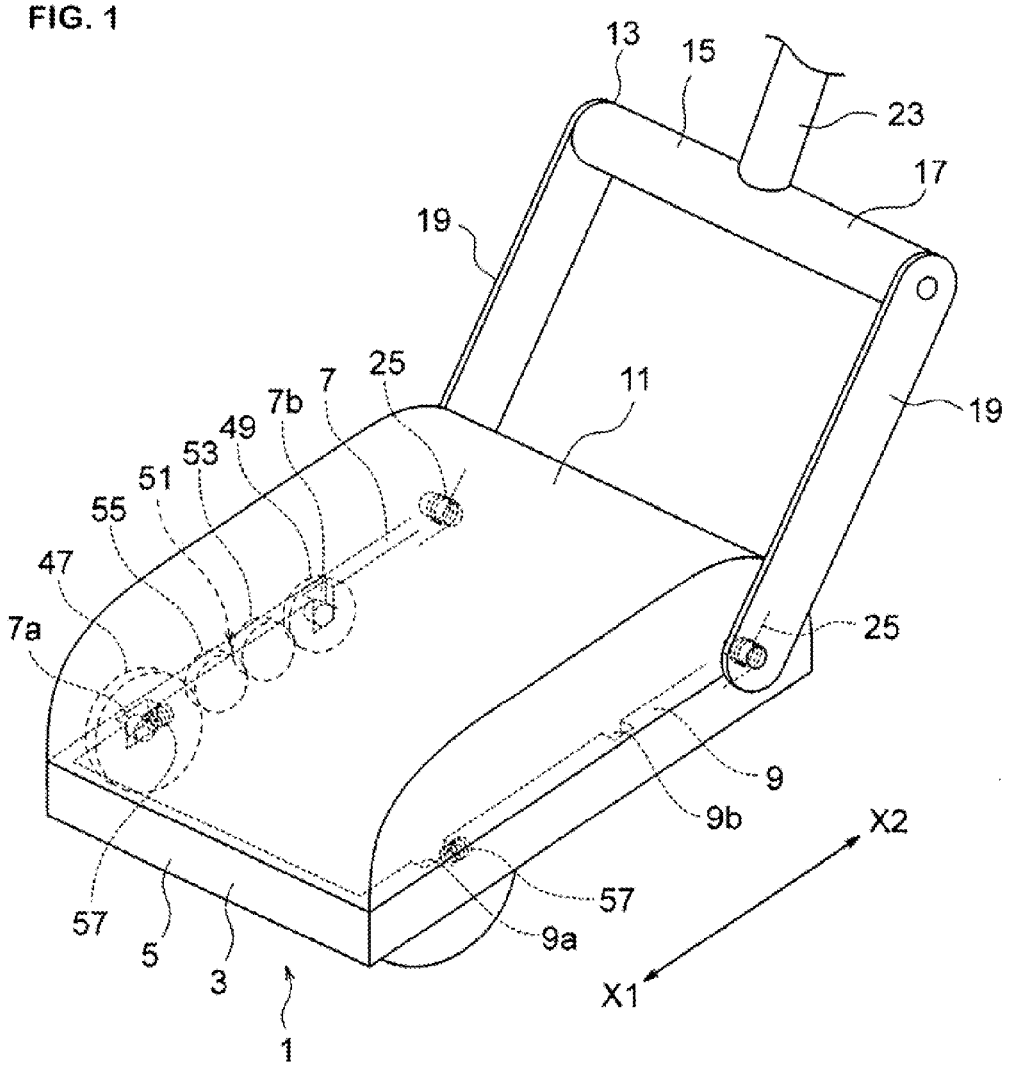
FIG. 1 is a schematic perspective view partially showing a first embodiment of the adhesive roller-type cleaning tool of the present invention.

FIG. 1 is a schematic perspective view showing an example of the adhesive roller-type cleaning tool of the present embodiment, comprising a case member 1, a grip unit 13 connected to the case member 1 to be rotatable forward and backward, an adhesive roller unit 27 deployed inside the case member 1 to be rotatable forward and backward (normal rotation/reverse rotation), a take-up unit 39 for winding up adhesive sheet 37 covered with adhered lint and the like after being drawn from the adhesive roller unit 27, and a rotation transmission unit 51 for transmitting rotation (normal rotation) of the adhesive roller unit 27 to the take-up unit 39.

Figure 2:
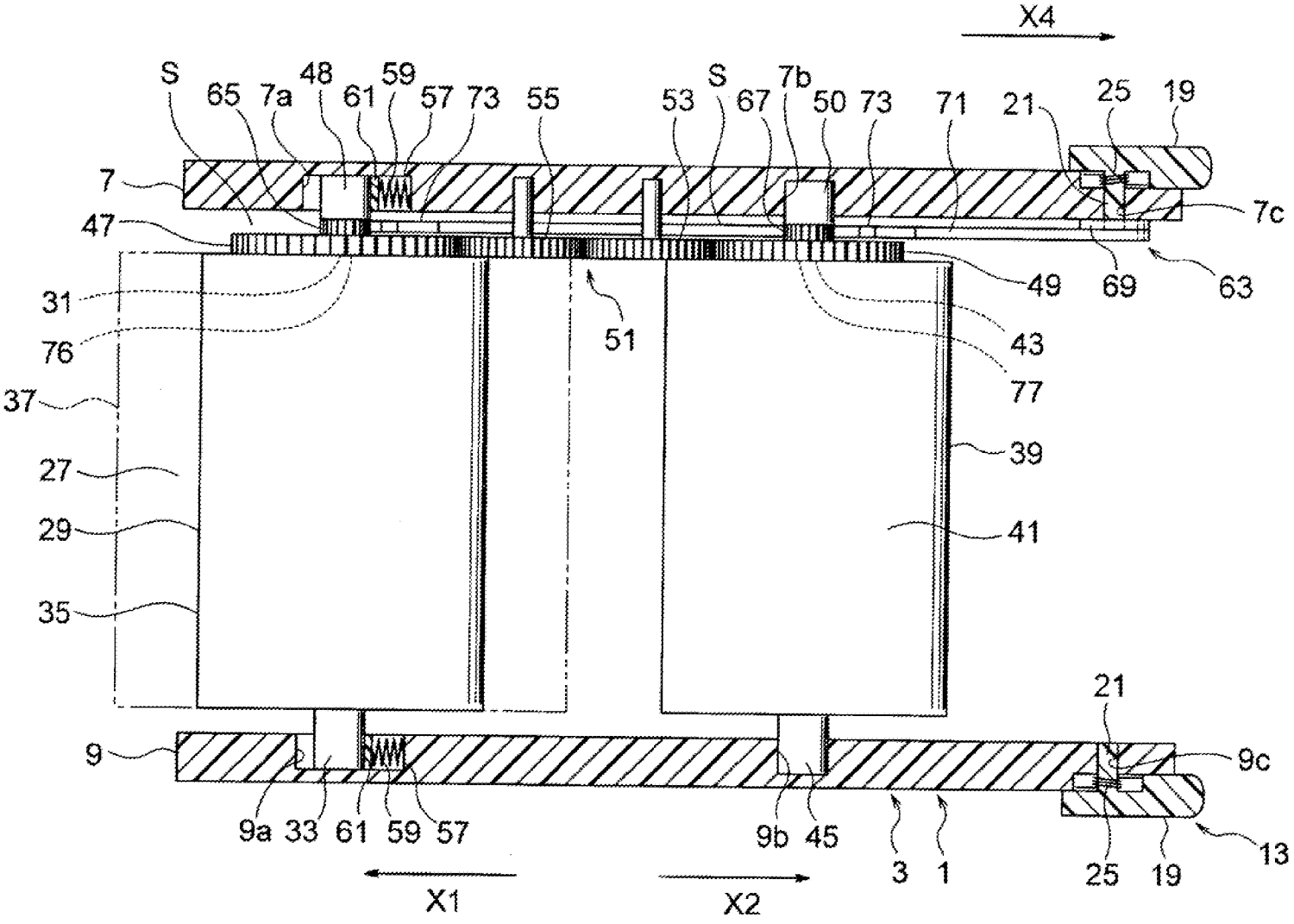
FIG. 2 is a schematic cross-sectional view partially showing the first embodiment of the adhesive roller-type cleaning tool of the present invention, depicting an adhesive roller unit and a take-up unit in a synchronized state.

The case member 1 comprises a first member 3 on which the adhesive roller unit 27, take-up unit 39 and rotation transmission unit 51 are mounted and a second member 11 for openably and closably covering a top of the first member 3, and has the grip unit 13 attached thereto near the rear end of the first member 3 (see FIGS. 1 and 2).

The first member 3 is formed of a front panel 5, rear panel (not shown), right panel 7 and left panel 9 to be approximately rectangular in plan view (see FIGS. 1 and 2).

The left panel 9 is provided with a shaft receiving portion 9*a* for accommodating a rotary shaft 33 of the adhesive roller unit 27 and a shaft receiving portion 9*b* for accommodating a rotary shaft 45 of the take-up unit 39. The shaft receiving portions 9*a*, 9*b* are provided to be open on a top face and a side face (side face opposing the right panel) of the left panel 9, in a configuration that enables both the rotary shaft 33 of the adhesive roller unit 27 and the rotary shaft 45 of the take-up unit 39 to be inserted from above.

The right panel 7 is provided with a gear shaft receiving portion 7*a* for accommodating a gear shaft 48 of a first gear 47 connected to a rotary shaft 31 of the adhesive roller unit 27 and a gear shaft receiving portion 7*b* for accommodating a gear shaft 50 of a second gear 49 connected to a rotary shaft 43 of the take-up unit 39. The shaft receiving portions 7*a*, 7*b* are provided to be open on a top face and a side face (side face opposing the left panel) of the right panel 7, in a configuration that enables both the gear shaft 48 of the first gear 47 and the gear shaft 50 of the second gear 49 to be inserted from above.

Further, the right panel 7 is provided with the rotation transmission unit 51 in a state meshed with the second gear 49 to be rotatable forward and backward.

Although not particularly illustrated in the drawing, the second member 11 in the present embodiment is, for example, pivotally supported near the rear end of the first member 3 to be rotatable forward and backward. More specifically, it is shaped like a lid to cover and house the adhesive roller unit 27, take-up unit 39 and other members provided in the first member 3. Its bottom face presses down on the openings of the shaft receiving portions 9*a*, 9*b* and the gear shaft receiving portions 7*a*, 7*b* exposed at the top faces of the right panel 7 and left panel 9 of the first member 3 so as to prevent upward detachment of the rotary shafts 33, 45 and gear shafts 48, 50 accommodated in the respective portions.

The grip unit 13 comprises a connector 15 of substantially angular U-shape in plan view and a vertical bar 23 attached to about the middle of a horizontal bar 17 of the connector 15. In the present embodiment, the user grasps the vertical bar 23 and push/pulls it to do cleaning. The connector 15 includes left and right connector pieces 19, 19 integrally joined to opposite ends of the horizontal bar 17, and the connector pieces 19, 19 are formed with opposing projections 21, 21.

The projections 21, 21 are inserted into connecting holes 7*c*, 9*c* provided toward the rear ends of the right panel 7 and the left panel 9 of the first member 3 so as to be rotatable forward and backward.

The grip unit 13 is energized to linearly align with the case member 1.

Figure 4:
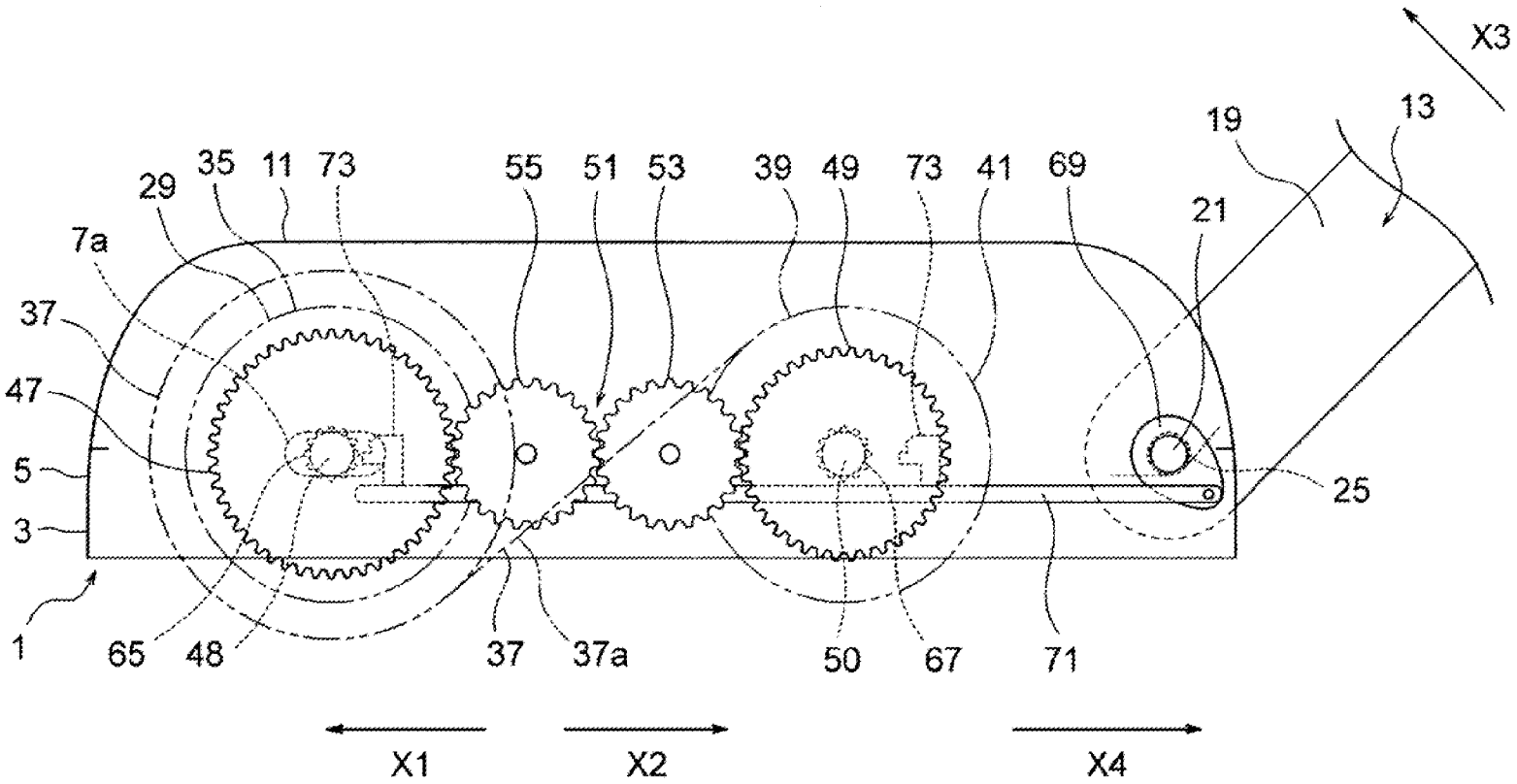
FIG. 4 is a schematic side view partially showing the first embodiment of the adhesive roller-type cleaning tool of the present invention, depicting the adhesive roller unit and the take-up unit in the synchronized state.
Figure 5:
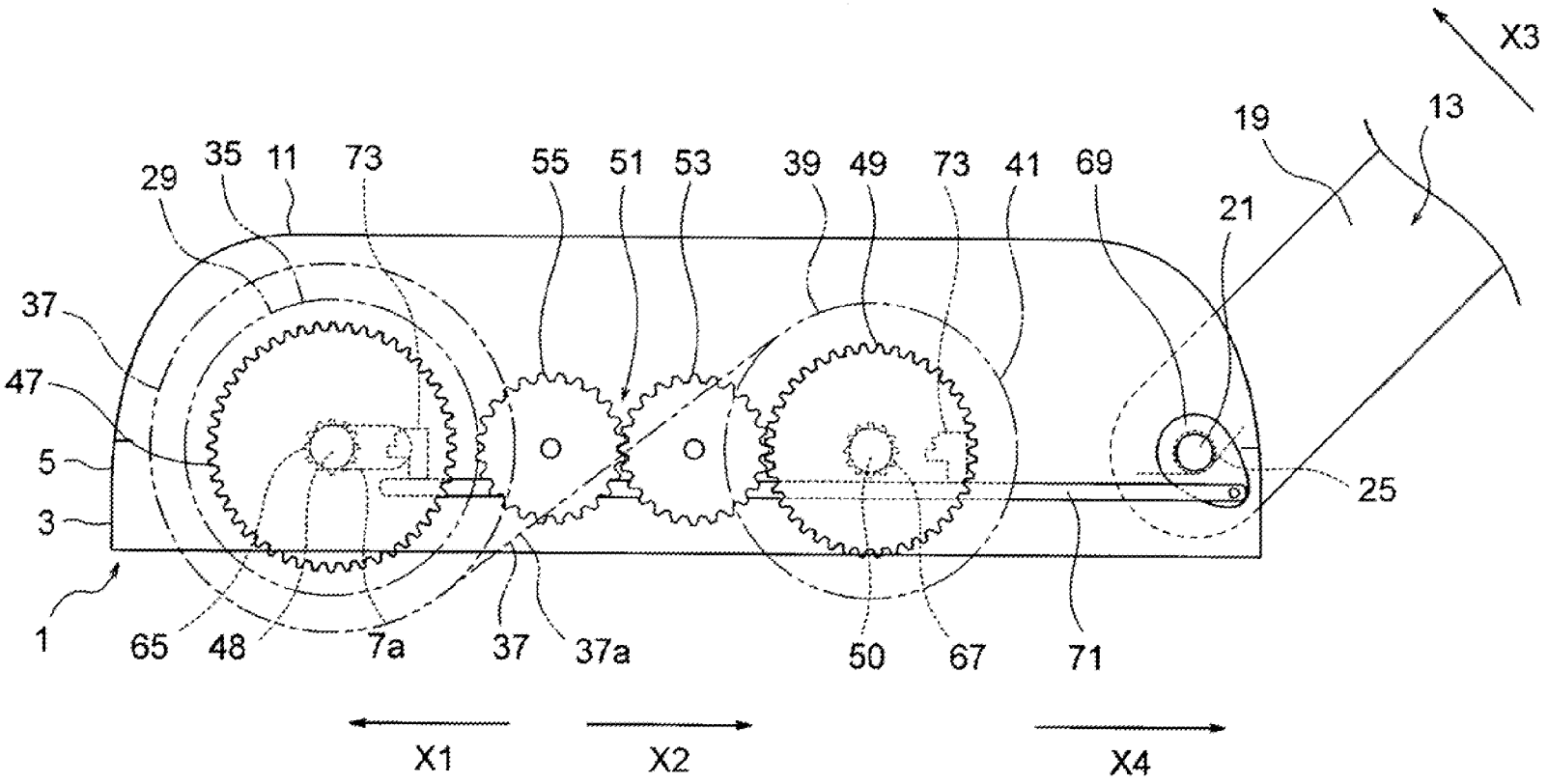
FIG. 5 is a schematic side view partially showing the first embodiment of the adhesive roller-type cleaning tool of the present invention, depicting the adhesive roller unit and the take-up unit in the desynchronized state.

In this embodiment, for example, elastic members (coil springs) 25 are deployed between the first member 3 and the connector pieces 19, 19 at the insertion points of the projections 21, 21 with their one ends pressing against the first member 3 and their other ends pressing against the connector pieces 19, 19, whereby the case member 1 and grip unit 13 are energized into linear alignment (FIG. 6), so that when the adhesive roller unit 27 is pressed onto a contact surface for use, the grip unit 13 is rotated forward against the elastic force of the elastic members 25 to be used in a forward-tilted condition (FIGS. 1, 4 and 5).

However, the structure, appearance and other aspects of the case member 1 and grip unit 13 are not to be construed as being particularly limited to those of the present embodiment but can be variously modified in structural and exterior design within the scope of the present invention.

The adhesive roller unit 27 comprises a core unit 35 including a cylinder 29 and the rotary shafts 31 and 33 integrally projecting from opposite sides of the core unit 35, and the adhesive sheet 37 wound around the cylinder of the core unit 35 in the shape of a drum of predetermined length.

The rotary shaft 31 is integrally key-jointed, for example, in a connection hole 76 formed at the center of a gear disk of the first gear 47 in a configuration that enables synchronous rotation of the first gear 47 and the adhesive roller unit 27.

The take-up unit 39, which winds up adhesive sheet 37 drawn from the adhesive roller unit 27 after it has been used for cleaning, comprises a cylinder 41 and the rotary shafts 43 and 45 integrally projecting from opposite sides of the cylinder 41.

The present embodiment makes use of the core unit 35 of the completely used adhesive roller unit 27. That is, the core unit 35 after the adhesive roller unit 27 has been used up is utilized as the take-up unit 39, which is very cost effective because the take-up unit 39 does not need to be separately manufactured.

The rotary shaft 43 is integrally key-jointed, for example, in a connection hole 77 formed at the center of a gear disk of the second gear 49 in a configuration that enables synchronous rotation of the second gear 49 and the take-up unit 39.

The first gear 47 and the second gear 49 differ in diameter. More specifically, in the present embodiment the second gear 49 is formed to have a smaller diameter than the first gear 47.

This is because at the beginning of use, the diameter of the take-up unit 39 (outer diameter of the cylinder) is greatly different (smaller) from the diameter of the adhesive roller unit 27 (outer diameter wound with adhesive sheet 37), so that the payout (draw-out) speed of the adhesive sheet 37 and the wind-up speed by the take-up unit 39 would be different. As slack would therefore occur in the adhesive sheet 37, the take-up unit 39 needs to be rotated rapidly to take up the slack.

In addition, this embodiment is configured so that when a certain amount of tension occurs during the wind-up operation of the take-up unit 39, the connection hole 77 of the second gear 49 and rotary shaft of the take-up unit 39 slip (rotate idly).

For example, although not illustrated in the drawings, the present embodiment is equipped with a so-called ratchet mechanism between the connection hole 77 of the second gear 49 and the rotary shaft 43 of the take-up unit 39.

In other words, the diameter of the take-up unit 39 becomes larger as the amount wound on the take-up unit 39 increases. Then when the diameter of the take-up unit 39 becomes larger than the diameter of the adhesive roller unit 27, tension acts on the adhesive sheet 37. When this condition arises, the take-up unit 39 can no longer wind up adhesive sheet. However, by adopting the configuration of the present embodiment, when a predetermined tension comes to act on the take-up unit 39, a condition is established whereby only the second gear 49 moves and the take-up unit 39 does not move (no adhesive sheet is wound for the duration), and then when the tension falls below the predetermined level, the second gear 49 and take-up unit 39 again cooperate to resume winding.

The rotation transmission unit 51 transmits rotation of the adhesive roller unit 27 to the take-up unit 39. The rotation transmission unit 51 in the present embodiment comprises two gears, namely, a third gear 53 constantly meshed with the second gear 49 and a fourth gear 55 constantly meshed with the third gear 53.

The third gear 53 and fourth gear 55 constituting the rotation transmission unit 51 are formed to be smaller in diameter than the first gear 47 and the second gear 49.

Owing to the adoption of this gear configuration, the first gear 47 and second gear 49 rotate in the same direction.

Moreover, the configuration of the third gear 53 and the fourth gear 55 to have smaller diameters than the first gear 47 and the second gear 49, respectively, minimizes the distance between the first gear 47 and the second gear 49 and thus prevents slack in the adhesive sheet 37.

The reasons for the aforesaid configuration are as follows:

A sticky surface 37*a* of the adhesive sheet 37 wound on the adhesive roller unit 27 faces outward.

Adhesive sheet 37 drawn out from the adhesive roller unit 27 (adhesive sheet 37 on the way from the adhesive roller unit 27 to the take-up unit 39) is unstable. As it might stick to something and be twisted before arriving at the take-up unit 39, it is desirably conveyed to the take-up unit 39 with the sticky surface 37*a* separated from the contact surface (flow surface) to the utmost possible. Therefore, the wind-up direction is made opposite to the direction of rotation of the adhesive roller unit 27 (draw-out direction), whereby drawn-out adhesive sheet 37 can be conveyed upward toward the top of the take-up unit 39 and thus kept away from the contact surface (floor surface). (As indicated by an imaginary line in FIG. 4, drawn-out adhesive sheet 37 can be set to be upwardly inclined toward the top of the take-up unit 39.)

Further, if the sticky surface 37*a* of the adhesive sheet 37 is made to face the surface of the cylinder 41 of the take-up unit 39, the adhesive force of the sticky surface 37*a* can be used to bridge the drawn-out adhesive sheet 37 across to the cylinder 41 simply by sticking it to the surface of the cylinder 41. As a result, the adhesive sheet can be extended across to the take-up unit 39 at the start of winding simply and inexpensively without using a special complicated structure.

The first gear 47 and the fourth gear 55 of the rotation transmission unit 51 are engaged when the adhesive roller unit 27 is pressed onto a contact surface and moved forward, and are energized to release the engagement of first gear 47 and the fourth gear 55 of the rotation transmission unit 51 when it is moved backward and when it is separated from the contact surface.

In the present embodiment, the energizing mechanism specifically adopts the following configuration. Explanation will be made based on FIG. 2 to FIG. 6.

A pusher member 57 for pushing the rotary shaft 33 of the gear shaft 48 and the rotary shaft 33 forward is installed in the shaft receiving portions of the right panel 7 and the left panel 9 that rotatably support the adhesive roller unit 27 in the first member 3 (the gear shaft receiving portions 7*a*, 7*b* and rotary shaft receiving portion 9*a*, 9*b*).

The pusher member 57 comprises elastic members 59 and pressing plates 61 that are provided on one ends of the elastic members 59 and operate through the rotary shaft 31 to constantly energize the adhesive roller unit 27 forward so as to separate the first gear 47 and the fourth gear 55 of the rotation transmission unit 51. More specifically, when the adhesive roller unit 27 is pressed onto a contact surface (floor surface) and rotated in the normal direction (advanced in the direction of arrow X1), the pressing force at this time overcomes the elastic force of the elastic members 59 and push the pusher member 57 backward. Then, the rearward pushing of the adhesive roller unit 27 causes the first gear 47 and the fourth gear 55 of the rotation transmission unit 51 to engage and transmit the rotation of the adhesive roller unit 27 (see FIGS. 2 and 4).

Figure 3:
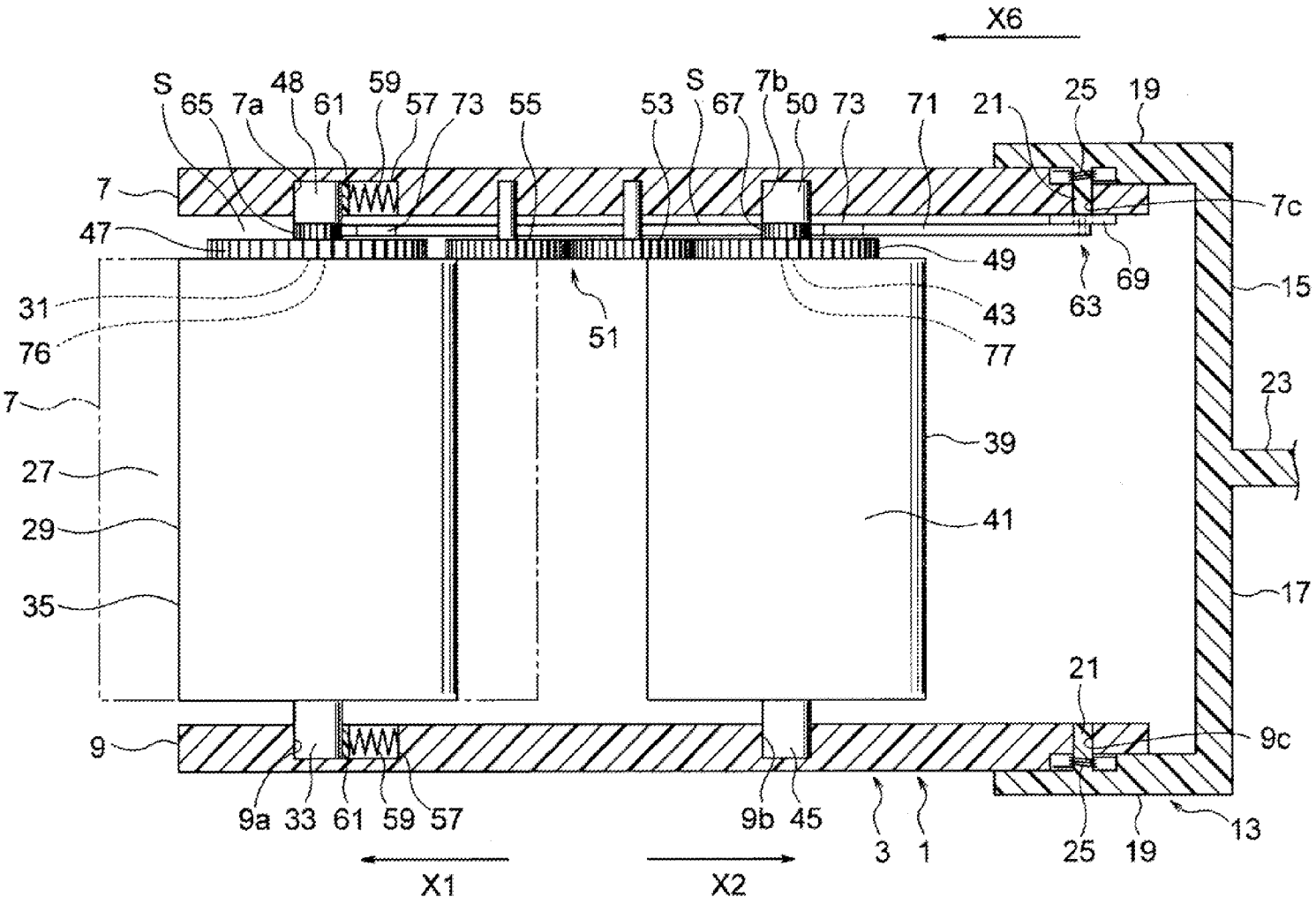
FIG. 3 is a schematic cross-sectional view partially showing the first embodiment of the adhesive roller-type cleaning tool of the present invention, depicting the adhesive roller unit and the take-up unit in a desynchronized state.
Figure 6:
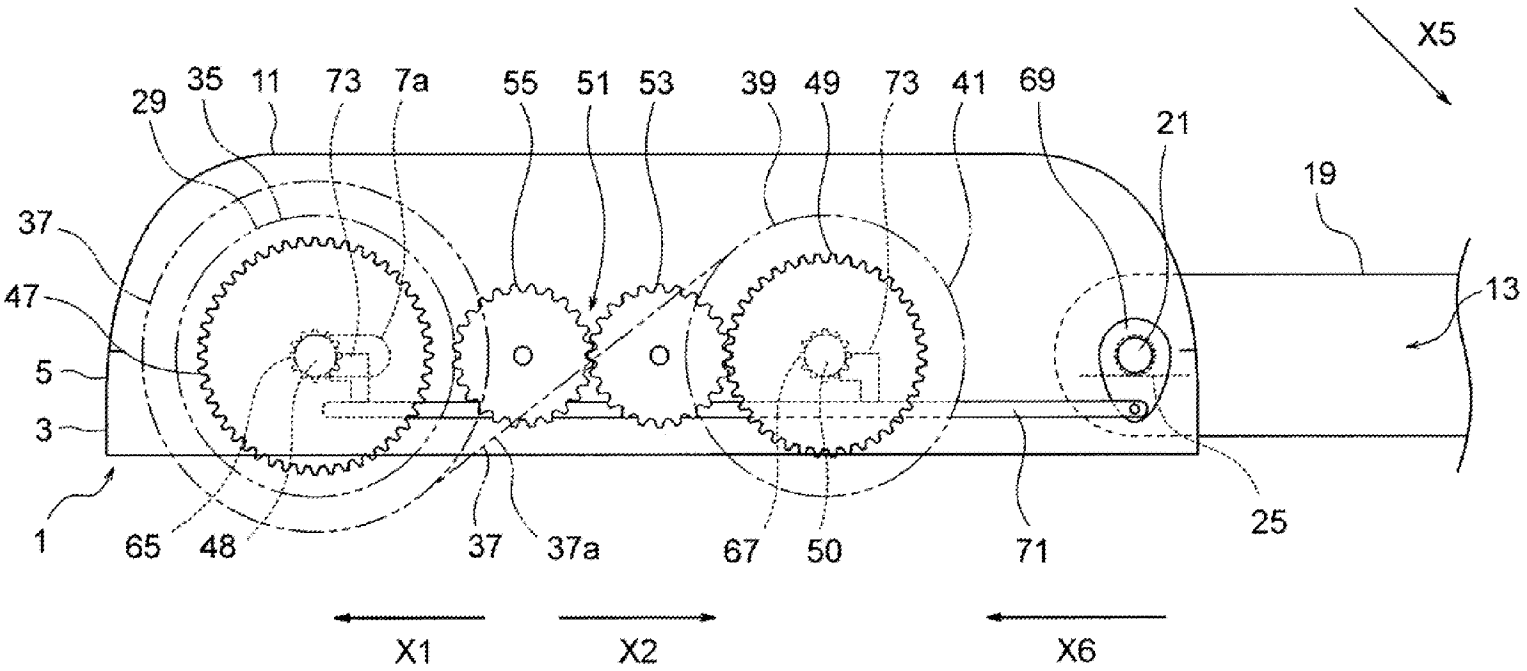
FIG. 6 is a schematic side view partially showing the first embodiment of the adhesive roller-type cleaning tool of the present invention, depicting the adhesive roller unit and the take-up unit in the desynchronized state and rotation of the adhesive roller unit and the take-up unit in a state inhibited by a rotation inhibiting mechanism.

During reverse movement, i.e., when the adhesive roller unit 27 is rotated in reverse to draw it nearer the user (moved backward in the direction of arrow X2), the pressing force that was acting on the adhesive roller unit 27 is released, so that the elastic force of the pusher member 57 acts through the rotary shaft to energize the adhesive roller unit 27 forward and separate the first gear 47 and the fourth gear 55 of the rotation transmission unit (release their engagement), whereby the adhesive roller unit 27 is put in a free rotating state (state free to rotate forward or backward) (FIGS. 3, 5 and 6).

Therefore, load-free operation is possible when pushing/pulling the adhesive roller unit 27 forward or backward.

However, the energizing mechanism is in no way to be construed as being limited to that of the present embodiment and can be modified in design within the scope of the present invention.

In the present embodiment, a rotation inhibiting mechanism 63 is provided that inhibits rotation (normal rotation and reverse rotation) of both the adhesive roller unit 27 and the take-up unit 39 when the adhesive roller unit 27 separates from the contact surface, i.e., when the cleaning tool is lifted up for movement to another location or when cleaning is finished.

The present embodiment is configured to synchronize the rotation inhibiting mechanism 63 with the forward/backward operation of the grip unit 13.

For example, a configuration is adopted whereby rotation of the adhesive roller unit 27 and take-up unit 39 are inhibited when the grip unit 13 is linearly aligned with the case member 1 by the energizing force and the inhibiting action is released when the adhesive roller unit 27 is pressed onto a contact surface to overcome the energizing force.

The specific details are as follows.

The gear shafts of the first gear 47 and the second gear 49 are provided with meshing portions. The meshing portions are formed to be located in a gap S between the first gear 47 and the right panel 7 and in a gap S between the second gear 49 and the right panel 7.

Here, the configuration comprises an eccentric disk 69 integrally fixed to a tip of the projection 21 integrally formed on the grip unit 13, an elongated operating arm 71 rotatably journaled on the eccentric disk 69 at a position offset from its center of rotation, and inhibiting portions 73, 73 that are formed to stick up at predetermined positions of the operating arm 71 and are formed at their tips with concavo-convex portions engageable with the meshing portions.

When the grip unit 13 is rotated forward (direction of arrow X3), the eccentric disk 69 follows this action by rotating backward (direction of arrow X4). By this, the operating arm 71 is drawn backward (direction of arrow X4) to also move the inhibiting portions 73, 73 backward (direction of arrow X4). This does not restrain rotation of the adhesive roller unit 27 and the take-up unit 39. And when the grip unit 13 is rotated backward (direction of arrow X5), the eccentric disk 69 follows this action by rotating forward (direction of arrow X6).

By this, the operating arm 71 is pushed forward, and the inhibiting portions 73, 73 are moved into engagement with the meshing portions 65, 67 of the first gear 47 and the second gear 49 and thereby inhibit rotation of the adhesive roller unit 27 and take-up unit 39.

Therefore, even if adhesive sheet should inseparably stick to a floor surface, unintentional withdrawal of adhesive sheet is restrained because rotation of both the adhesive roll 27 and the take-up unit 39 is inhibited.

Although the present embodiment is equipped with the rotation transmission unit 51 comprising the third gear 53 and fourth gear 55, the number of gears constituting the rotation transmission unit 51 is not particularly limited.

Moreover, a mode that makes no use whatsoever of the rotation transmission unit 51 also falls within the scope of the present invention.

Second Embodiment

FIGS. 7 to 13 show a second embodiment of the present invention.

The adhesive roller-type cleaning tool of this embodiment is more compact and even easier to use than the adhesive roller-type cleaning tool of the first embodiment.

Figure 7:
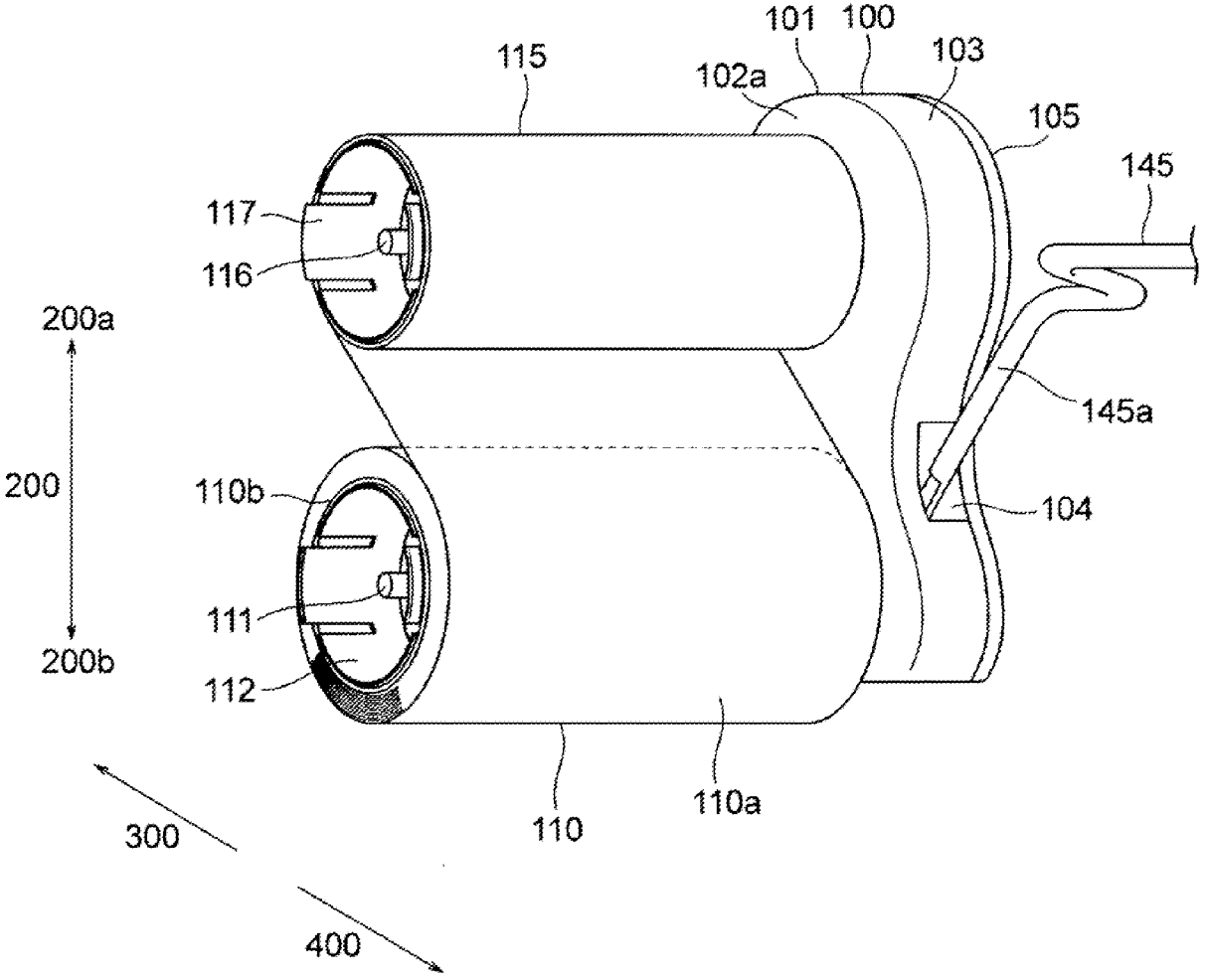
FIG. 7 is a schematic perspective view partially showing a second embodiment of the adhesive roller-type cleaning tool of the present invention.

FIG. 7 is a schematic perspective view of the adhesive roller-type cleaning tool of the present embodiment, wherein 100 designates a case member, 110 an adhesive roller unit, 115 a take-up unit, and 145 a grip unit. In the present embodiment, the adhesive roller unit 110 and take-up unit 115 are arranged vertically in parallel (direction of arrow 200 in FIGS. 7 and 8).

The case member 100 comprises a case body 101 and a case cover 105.

The case body 101 comprises a base plate 102 of predetermine shape and a peripheral wall 103 erected on the periphery of the base plate 102 to have a depth (thickness) large enough to accommodate the mechanical structure components (first to fourth gears 120 to 127, gear retaining plate 130, handle base plate 135, and handle plate 141) of the cleaning tool of the present embodiment.

An outer face 102*a* of the base plate 102 is provided at positions vertically spaced by a predetermined distance (in the direction of arrow 200) with a through-hole (not shown) communicating with an inner face 102*b* for retaining an adhesive roller unit rotary shaft 111 and with a through-hole (not shown) for retaining a take-up unit rotary shaft 116.

The inner face 102*b* of the case body 101 is provided with a receiving hole (not shown) for receiving a rotary shaft 128 of a third gear 126 that is a component of a rotation transmission unit 125, and the receiving hole for the rotary shaft 128 of the third gear 126 is provided to lie on the same vertical line (in the direction of arrow 200) as the through-hole for the take-up unit rotary shaft 116.

In addition, the inner face 102*b* of the base plate 102 is provided with a bearing 106 for rotatably journaling one end 130*a* of the gear retaining plate 130. A notch is formed at a lower part of the rear face (outer face) face 102*a* of the case body 101 to serve as a hole 104 for passing the grip unit when the case member 100 is formed by attaching a case cover 105.

At positions of the inner face of the case cover 105 corresponding to those where the through-hole for retaining the adhesive roller unit rotary shaft 111 and the through-hole for retaining the take-up unit rotary shaft 116 are provided on the case body 101, are respectively provided a receiving hole (not shown) for rotatably receiving one end of the adhesive roller unit rotary shaft 111 and a receiving hole (not shown) for rotatably receiving one end of the take-up unit rotary shaft 116.

However, the structure, appearance and other aspects of the case member 100 are not to be construed as being particularly limited to those of the present embodiment but can be variously modified in structural and exterior design within the scope of the present invention.

The adhesive roller unit 110 is supported to be rotatable forward and backward by the adhesive roller unit rotary shaft 111 projecting outward of the case member 100 (outward of the case body 101), and the take-up unit 115 is supported to be rotatable forward and backward by the take-up unit rotary shaft 116 projecting outward of the case member 100.

The adhesive roller unit rotary shaft 111 is formed as a rod of predetermined diameter and length, whose one end is rotatably supported in the case member 100 by the aforesaid (unshown) retaining through-hole and receiving hole and other end projects outside the case member 100 through the aforesaid (not shown) retaining through-hole.

The adhesive roller unit rotary shaft 111 and the adhesive roller unit 110 are required to rotate synchronously. One example of a mechanism for this that can be mentioned is, for example, to integrally provide a sleeve 112 of substantially cylindrical shape on the periphery of the other end of the adhesive roller unit rotary shaft 111 that projects outward of the case member 100 and snugly fit the sleeve 112 on the cylindrical inner face of the adhesive roller unit 110. This enables the adhesive roller unit rotary shaft 111 and the adhesive roller unit 110 to rotate synchronously.

The mechanism for synchronous rotation is not to be construed as being particularly limited and other known mechanisms can be suitably modified.

The adhesive roller unit 110 has a predetermined length of adhesive sheet 110*a* wound drum-like on the outer periphery of a cylindrical core 110*b*. A conventional known configuration can be suitably adopted for the adhesive roller unit 110 and should not be construed as particularly limited.

One end of the take-up unit rotary shaft 116 is rotatably supported in the case member 100 by the aforesaid retaining through-hole and receiving hole and other end projects outside the case member 100 through the aforesaid retaining through-hole, thereby rotatably supporting the cylindrical take-up unit 115.

The take-up unit rotary shaft 116 and the take-up unit 115 are required to rotate synchronously. One example of a mechanism for this that can be mentioned is, similarly to the adhesive roller unit rotary shaft 111, to integrally provide a sleeve 117 of substantially cylindrical shape on the periphery of the other end of the take-up unit rotary shaft 116 and snugly fit the sleeve 117 on the cylindrical inner face of take-up unit 115. This enables the take-up unit rotary shaft 116 and the take-up unit 115 to rotate synchronously. The mechanism for synchronous rotation is not to be construed as being particularly limited and other known mechanisms can be suitably modified.

The take-up unit 115, which winds up adhesive sheet 110*a* drawn from the adhesive roller unit 110 after it has been used for cleaning, is formed in a cylindrical shape.

In the present embodiment, the cylindrical core 110*b* of the completely used adhesive roller unit 110 is utilized. That is, the cylindrical core 110*b* after the adhesive roller unit 110 has been used up is utilized as the take-up unit 115, which is very cost effective because the take-up unit 115 does not need to be separately manufactured One ends of the adhesive roller unit rotary shaft 111 and the take-up unit rotary shaft 116 are accommodated in the case member 100 as explained in the foregoing, a first gear 120 and a first meshing portion 121 are integrally provided on the one end of the adhesive roller unit rotary shaft 111, and a second gear 122 and a second meshing portion 123 are integrally provided on the one end of the take-up unit rotary shaft 116.

The first gear 120 is formed in the shape of a disk of predetermined diameter, and the one end of the adhesive roller unit rotary shaft 111 is passed through and integrated with a connection hole 120*a* formed at the center of the disk of the first gear 120 (see FIGS. 8 to 13). The first gear 120 is integrated with the adhesive roller unit rotary shaft 111 through a key joint or other predetermined joint structure so as to rotate unitarily therewith. A configuration that ensures that the first gear 120 does not turn around the outer periphery of the adhesive roller unit rotary shaft 111 suffices and the structure thereof is not particularly limited.

Figure 12:
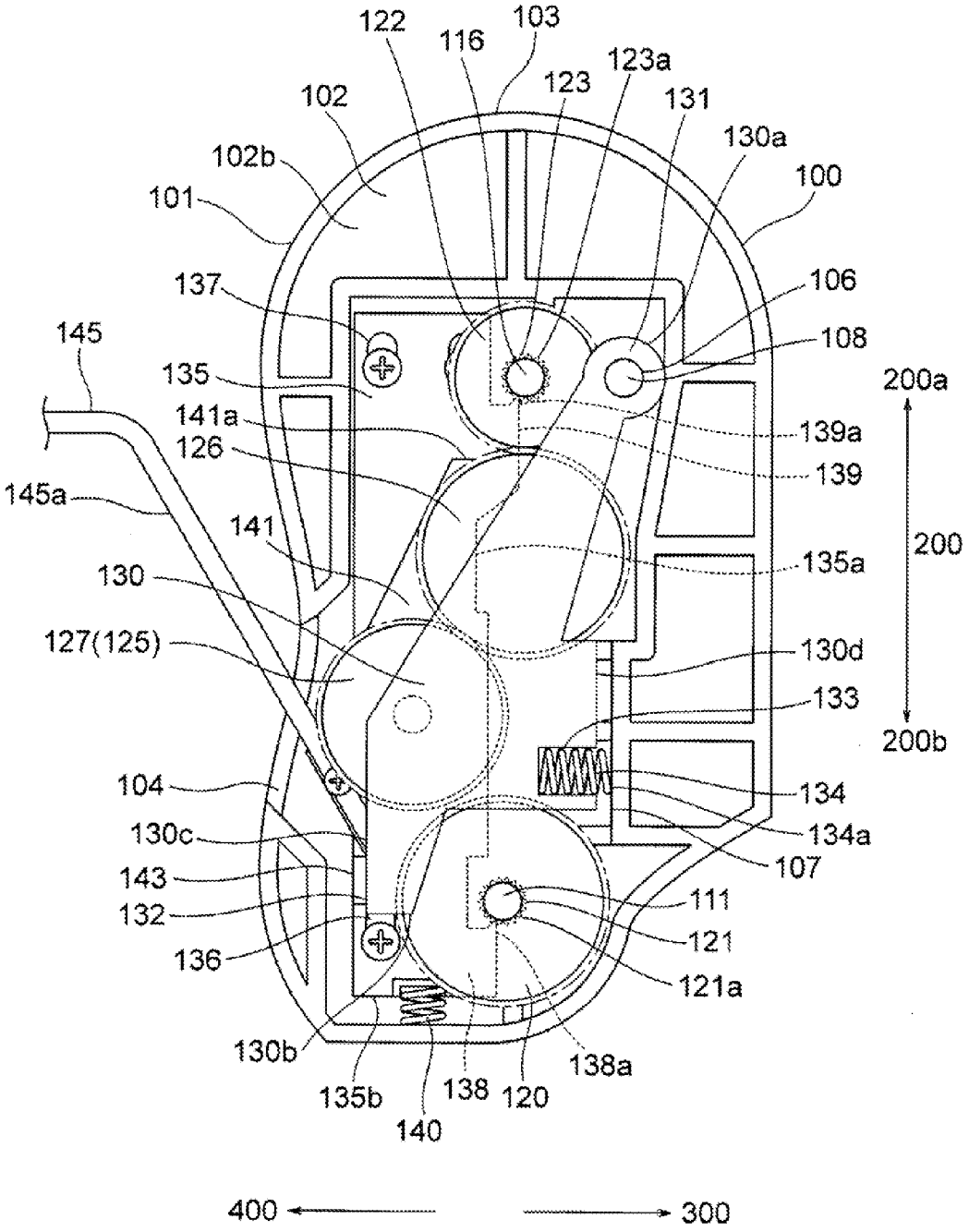
FIG. 12 is a schematic side view of the state in FIG. 10, showing a state in which upper and lower inhibiting units of a rotation inhibiting mechanism provided on the handle base plate respectively make locking engagement with a first meshing portion and a second meshing portion, thereby inhibiting rotation of the adhesive roller unit and the take-up unit.
Figure 13:
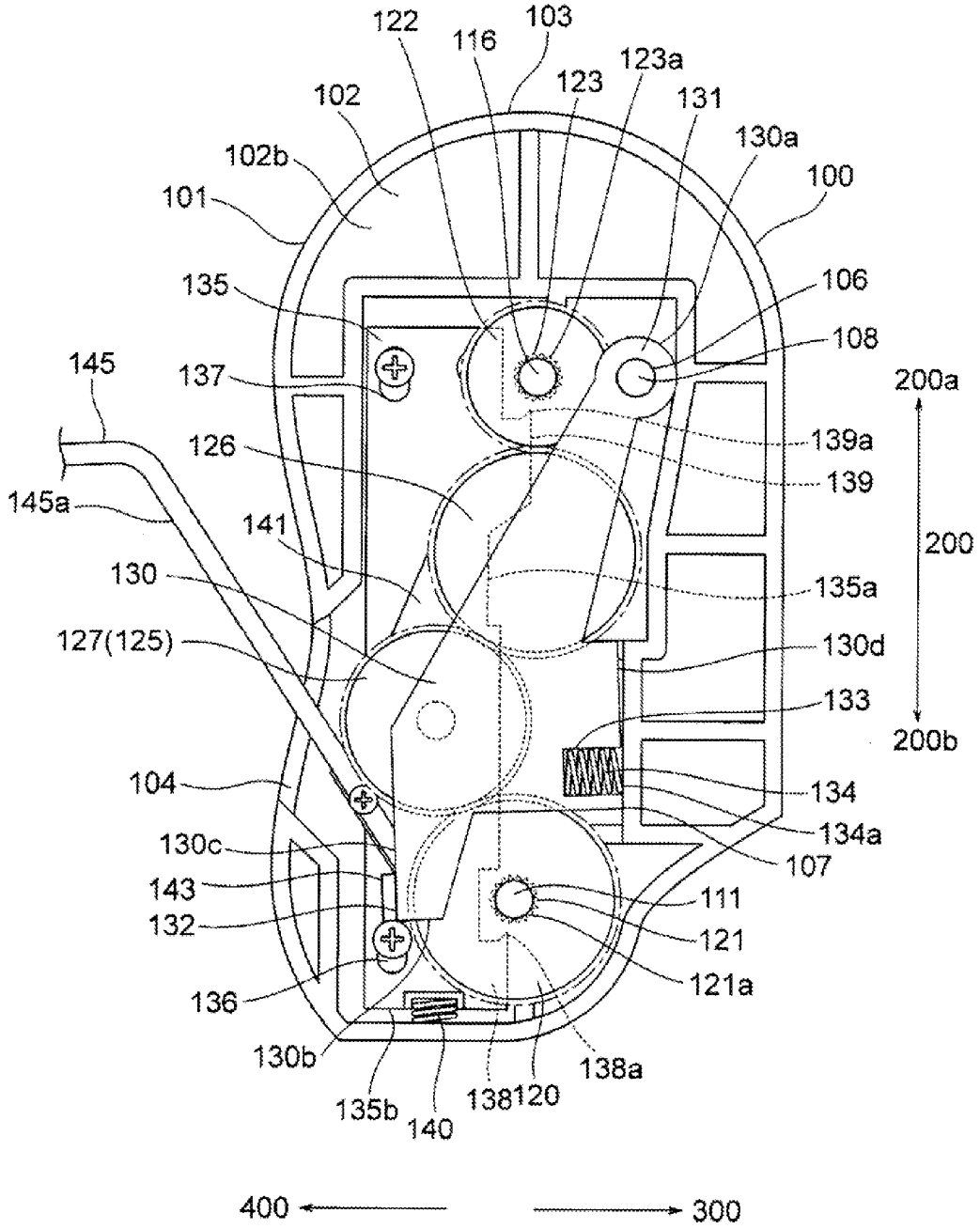
FIG. 13 is a schematic side view of the state in FIG. 11, showing the upper and lower inhibiting units of the rotation inhibiting mechanism provided on the handle base plate respectively separated from the first meshing portion and the second meshing portion, thereby releasing the rotation inhibited state of the adhesive roller unit and the take-up unit.

The first meshing portion 121 is cylindrically formed to be very small in diameter and short in length compared to the first gear 120, and a concavo-convex portion 121*a* is formed on the outer periphery thereof (see FIGS. 12 and 13). Like the first gear 120, the first meshing portion 121 is integrated through a predetermined structure to rotate unitarily with the adhesive roller unit rotary shaft 111.

Alternatively, the first meshing portion 121 can be a concavo-convex portion formed directly at a predetermined location on the periphery of the adhesive roller unit rotary shaft 111.

The second gear 122 is formed in the shape of a disk of smaller diameter than the first gear 120, and the one end of the take-up unit rotary shaft 116 is passed through and integrated with a connection hole 122*a* formed at the center of the disk of the second gear 122 (see FIGS. 8 to 13). The second gear 122 is integrated with the take-up unit rotary shaft 116 through a key-joint or other predetermined joint structure so as to rotate unitarily therewith. A configuration that ensures that the second gear 122 does not turn around the outer periphery of the take-up unit rotary shaft 116 suffices and the structure thereof is not particularly limited.

The operational effect of the diameters of the first gear 120 and the second gear 122 being made different in this way is the same as explained regarding the first embodiment and is similarly exhibited in the present embodiment.

The second meshing portion 123 is cylindrically formed to be very small in diameter and short in length compared to the second gear 122 (to have the same shape as the first meshing portion 121), and a concavo-convex portion 123*a* is formed on the outer periphery thereof (see FIGS. 12 and 13).

Like the second gear 122, the second meshing portion 123 is also integrated through a predetermined structure to rotate unitarily with the take-up unit rotary shaft 116.

Alternatively, the second meshing portion 123 can be a concavo-convex portion formed directly at a predetermined location on the periphery of the take-up unit rotary shaft 116.

The rotation transmission unit 125 of the present embodiment comprises the third gear 126 and a fourth gear 127 that are installed in the case member 100 between the first gear 120 and the second gear 122.

The third gear 126 is formed in the shape of a disk of about the same diameter as the first gear 120, and a sleeve hole 126*a* for fitting a rotary shaft is formed at the center of the disk.

Figure 9:
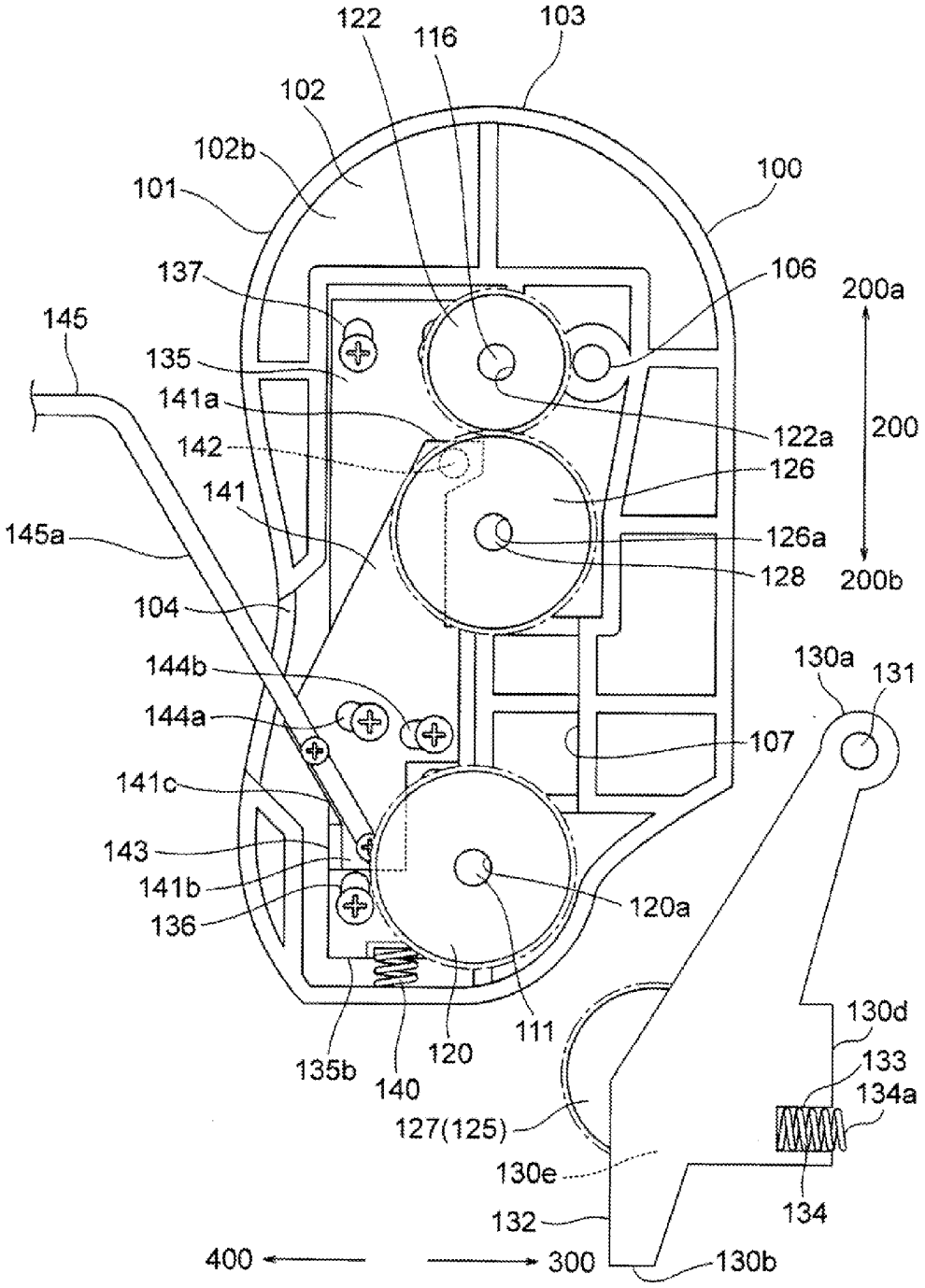
FIG. 9 is a schematic side view showing a state with a gear retaining plate and an associated fourth gear removed from the state in FIG. 8.
Figure 10:
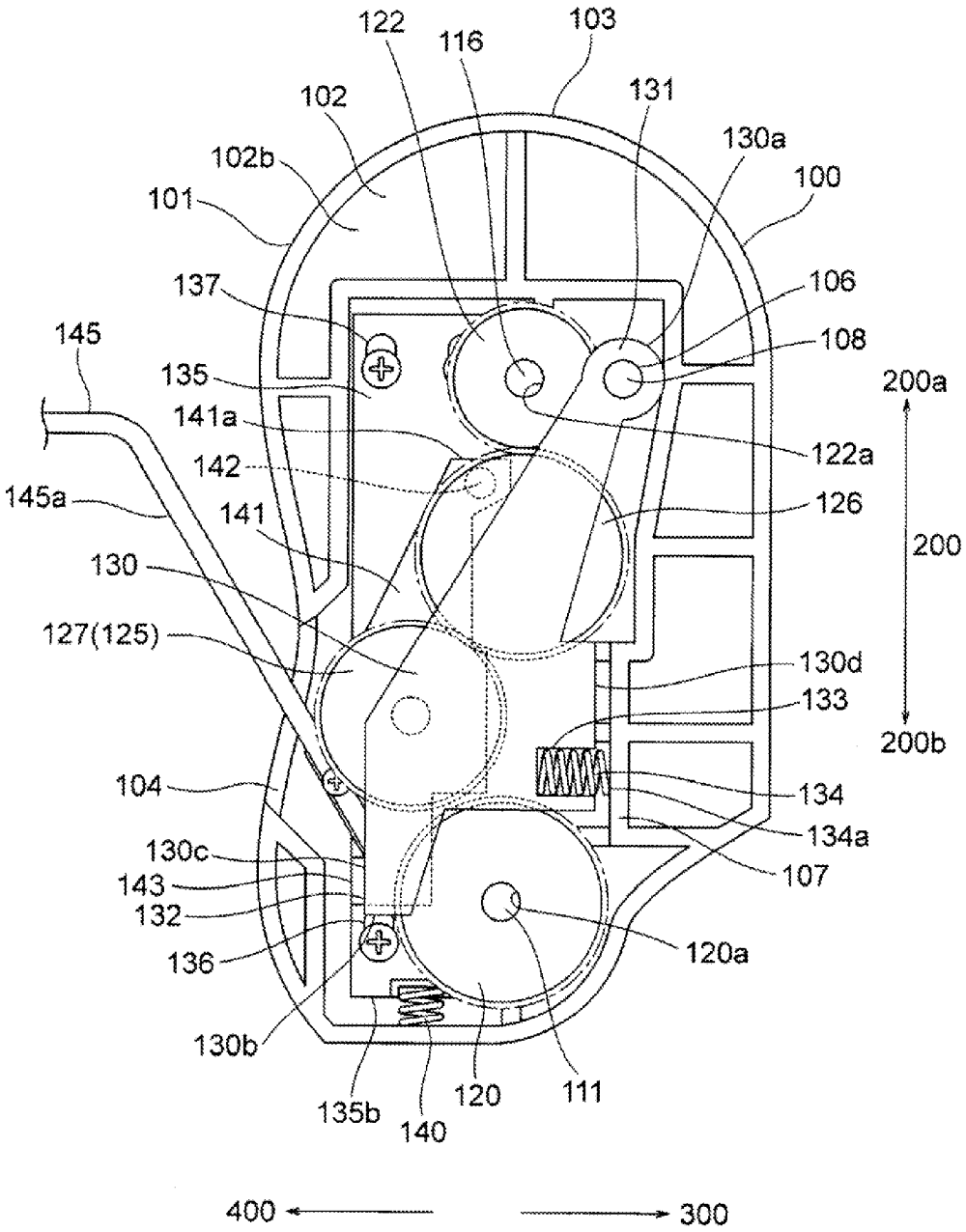
FIG. 10 is a schematic side view of the state in FIG. 8, with a broken line indicating a state with the fourth gear separated from the first gear.

The rotary shaft 128 for the third gear 126 it is rotatably disposed in a receiving hole for receiving the rotary shaft 128 for the third gear 126 provided in the inner face 102*b* of the base plate 102 of the case body 101 so as to be to be offset somewhat forward (in the direction of arrow 300 in the drawing) relative to the axis of the rotary shaft of the first gear 120 (adhesive roller unit rotary shaft 111) (see FIG. 9). By this, the rotary shaft of the second gear 122 (take-up unit rotary shaft 116) also comes to be offset somewhat forward (in the direction of arrow 300 in the drawing) relative to the axis of the rotary shaft of the first gear 120 (adhesive roller unit rotary shaft 111). Further, the third gear 126 and the second gear 122 are positioned with their axes on the same vertical line (in the direction of arrow 200) and are constantly meshed.

The fourth gear 127 is formed to have a smaller diameter than the first gear 120 and a larger diameter than the second gear 122 and is rotatably supported on a face of the gear retaining plate 130 (face 130*e* opposing the inner face of the case body 101) whose one end 130*a* is rotatably journaled on the inner face 102*b* of the case member 100.

The gear retaining plate 130 comprises a journaling portion 131 provided at one end (upper end) 130*a*, a pressure receiving face 132 provided on a face (rear face) 130*c* of another end (lower end), i.e., end opposite from the journaling portion 131, and an elastic member housing space 133 is provided on a face (front face) 130*d* facing oppositely from the pressure receiving face 132 (see FIGS. 8 to 13).

The gear retaining plate 130 is attached to be rotatable forward and backward by means of the journaling portion 131 around a bolt 108 or the like in the bearing 106 provided on the inner face 102*b* of the case body 101.

The bearing 106 is provided at a predetermined location on the inner face 102*b* of the case body 101, and in the present invention side-by-side with the rotary shaft of the second gear 122 (take-up unit rotary shaft 116). And the gear retaining plate 130 is constantly energized by an elastic member 134 to position the pressure receiving face 132 obliquely rearward from this bearing position.

The elastic member 134, a coil spring, for example, is accommodated in the elastic member housing space 133 of the gear retaining plate 130 with one end 134*a* projecting, and the one end 134*a* projecting from the elastic member housing space 133 is received by a spring receiving portion 107 projecting from the inner face 102*b* of the case body 101.

Figure 8:
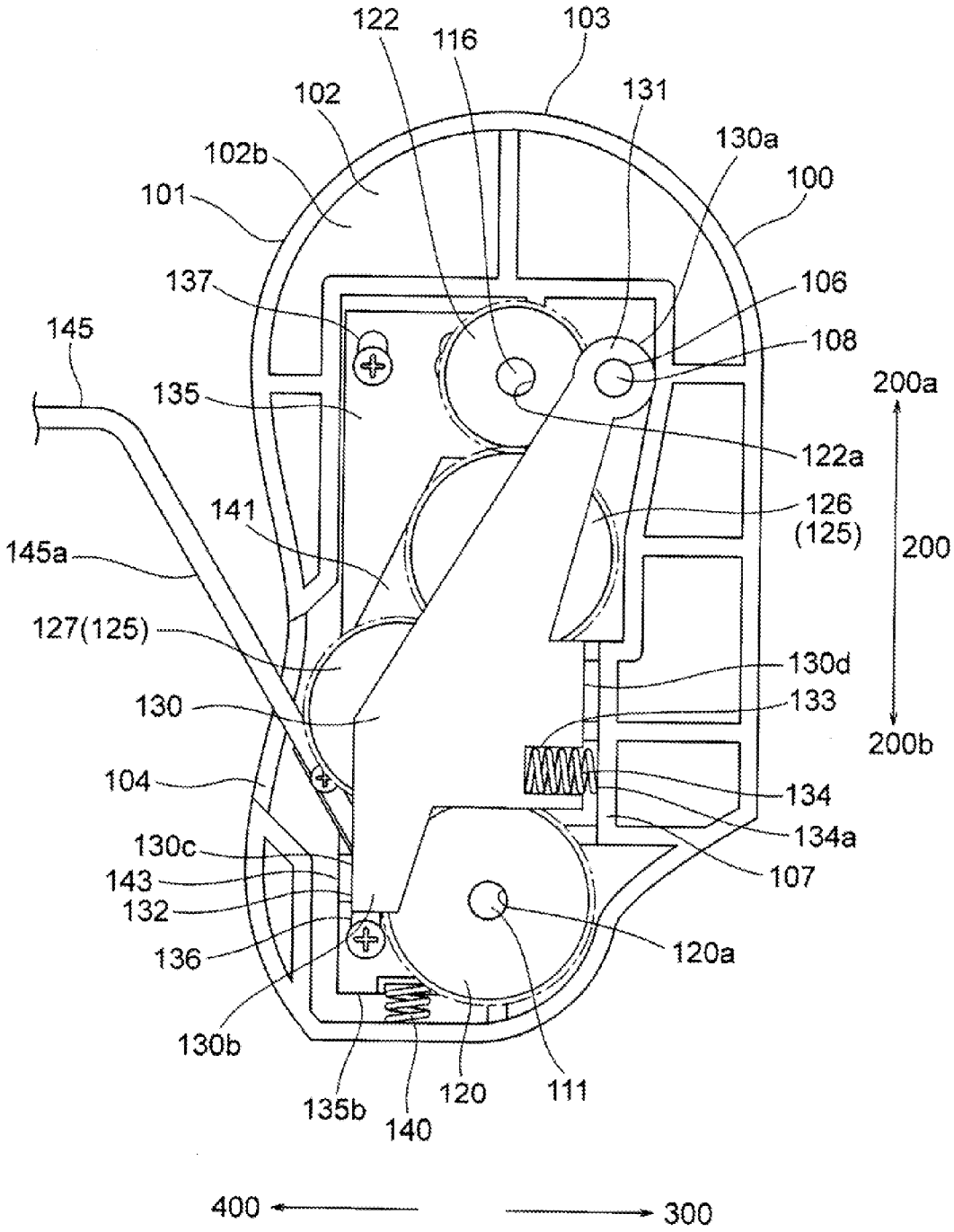
FIG. 8 is a schematic side view of the second embodiment of the adhesive roller-type cleaning tool of the present invention, wherein a grip unit is not being given a push-down action and a case cover is removed with a first gear and a second gear in a separated state.

By this, the elastic force of the elastic member 134 constantly energizes the gear retaining plate 130 around the journaling portion 131 clockwise as viewed in the drawings (backward direction indicated by arrow 400) (see FIG. 8). In this condition, the gear retaining plate 130 assumes a predetermined position that separates the fourth gear 127 from the first gear 120.

And when the pressure receiving face 132 of the gear retaining plate 130 is pushed by a presser 143 of the handle plate 141 discussed later, the gear retaining plate 130 overcomes the elastic force of the elastic member 134 and moves rotationally forward around the bearing 106 as a pivot point to mesh the fourth gear 127 with the first gear 120.

The elastic member 134 should not be construed as being limited to a coil spring but can be modified in design within the scope of the present invention.

The present embodiment is also designed to avoid damage to the gears by excessive pushing force from the grip unit 145. Specifically, a configuration is adopted whereby the front face 130*d* of the gear retaining plate 130 abuts on the spring receiving portion 107 to restrict further forward rotation of the gear retaining plate 130 after the fourth gear 127 engages the first gear 120 and enables transmission of the action of the first gear 120 (see FIGS. 11 and 13).

The handle base plate 135 is, for example, formed in the shape of a long flat plate provided at predetermined vertically spaced (in the direction of arrow 200) locations with a first oval hole 136 and a second oval hole 137 both elongated vertically. Then the handle base plate 135 is fastened by screws passed through the first oval hole 136 and second oval hole 137 into screw holes (not shown) provided in the inner face 102*b* of the case body 101, whereby it is installed to be linearly (vertically) movable relative to the inner face 102*b* of the case body 101 up and down (direction of arrow 200) along the first oval hole 136 and second oval hole 137.

As a mechanism that, similar to the rotation inhibiting mechanism 63 described earlier, is responsive to vertical movement of the handle base plate 135 for locking by engagement with the first meshing portion 121 and the second meshing portion 123 and unlocking by separating therefrom, the handle base plate 135 is integrally equipped with a first inhibitor (first locking claw) 138 and a second inhibitor (second locking claw) 139.

An example of this mechanism is explained as follows.

The first inhibitor 138 projects from a lower part of a front face 135*a* of the handle base plate 135 so as to point a claw 138*a* of predetermined shape toward the first meshing portion 121, thereby enabling locking engagement with the concavo-convex portion 121*a* of the first meshing portion 121 from below. The second inhibitor 139 projects from an upper part of the front face 135*a* of the handle base plate 135 so as to point a claw 139*a* of predetermined shape toward the second meshing portion 123, thereby enabling locking engagement with the concavo-convex portion 123*a* of the second meshing portion 123 from below.

More specifically, when the handle base plate 135 moves upward, the claw 138*a* of the first inhibitor 138 makes locking engagement with the concavo-convex portion 121*a* of the first meshing portion 121 from below the first meshing portion 121, and the claw 139*a* of the second inhibitor 139 makes locking engagement with the concavo-convex portion 123*a* of the second meshing portion 123 from below the second meshing portion 123.

And when the handle base plate 135 moves downward, the first inhibitor 138 and the second inhibitor 139 separate from the concavo-convex portion 121*a* of the first meshing portion 121 and the concavo-convex portion 123*a* of the second meshing portion 123 to release the locking engagement.

Moreover, the handle base plate 135 is constantly energized upward (direction of arrow 200*a*) by an elastic member 140 installed at its lower end. The elastic member 140 is presumed to be a coil spring, for example, interposed between a lower end 135*b* of the handle base plate 135 and the peripheral wall 103 of the case body 101.

Owing to the adoption of this configuration, the handle base plate 135 is constantly urged upward (direction of arrow 200*a*) by the elastic force of the elastic member 140, so that in the absence of a downward pushing force (in the direction of arrow 200*b*), the first inhibitor 138 and the second inhibitor 139 stay engaged with the first meshing portion 121 and the second meshing portion 123.

One end 141*a* of handle plate 141 is rotatably journaled on the handle base plate 135, thus being attached to be movable vertically (direction of arrow 200) together with the handle base plate 135. Further, one end of the grip unit (handle) 145 is integrally connected to the handle plate 141.

The one end (upper end) 141*a* of the handle plate 141 is provided with a journaling portion (shaft hole) 142, and the presser 143 is provided to project from a rear face 141*c* of another end (lower end) 141*b*, i.e., end opposite from the journaling portion 142.

The presser 143 projects in the shape of a flat plate of predetermined length at a position opposite to and contacting the pressure receiving face 132 of the gear retaining plate 130. In the present embodiment, a guide mechanism for the handle plate 141 is adopted to eliminate deviation when the handle plate 141 rotates around the journaling portion 142.

To explain by way of an example, the handle plate 141 is provided at predetermined positions with oval holes 144*a*, 144*b* and screw-fastened to the handle base plate 135 via the oval holes 144*a*, 144*b*, whereby the rotation of the handle plate 141 is guided by the oval holes 144*a*, 144*b* without deviating.

Pressing down the grip unit 145 causes the presser 143 to press the gear retaining plate 130 and engage the fourth gear 127 with the first gear 120.

The grip unit 145 comprises an inclined portion 145*a* inserted into the case member 100 at a downward incline and a handle portion (not shown) connected to the inclined portion 145*a* to extend horizontally.

In accordance with the present embodiment, the user grasps this handle and cleans by a push-pull action. The shape, attachment position and the like of the grip unit 145 can be arbitrarily decided without particular limitation.

The operation/working of the adhesive roller-type cleaning tool of the present embodiment will be explained.

When the cleaning tool is not in use, the fourth gear 127 is energized in the direction (direction of arrow 400) of separating from the first gear 120 (see FIGS. 8 to 10 and FIG. 12).

When the cleaning tool is used and the adhesive roller unit 110 is brought in contact with a floor surface or the like, the weight of, inter alia, the grip unit 145, the handle base plate 135 and handle plate 141, causes the handle base plate 135 to move downward (direction of arrow 200*b*) relative to the case member 100. As a result, the first inhibitor 138 and second inhibitor 139 of the handle base plate 135 are released from the state of inhibiting rotation by locking engagement with the first meshing portion 121 of the adhesive roller unit rotary shaft 111 and with the second meshing portion 123 of the take-up unit rotary shaft 116 (see FIGS. 11 and 13).

Simultaneously, the handle plate 141 rotates forward (direction of arrow 300) and the pressure receiving face 132 of the gear retaining plate 130 is pressed by the presser 143, whereby the gear retaining plate 130 rotates forward (direction of arrow 300) against the elastic force of the elastic member 134.

As a result, the fourth gear 127 engages the first gear 120, and all engaged states are established in the manner of first gear 120→fourth gear 127→third gear 126→second gear 122.

Figure 11:
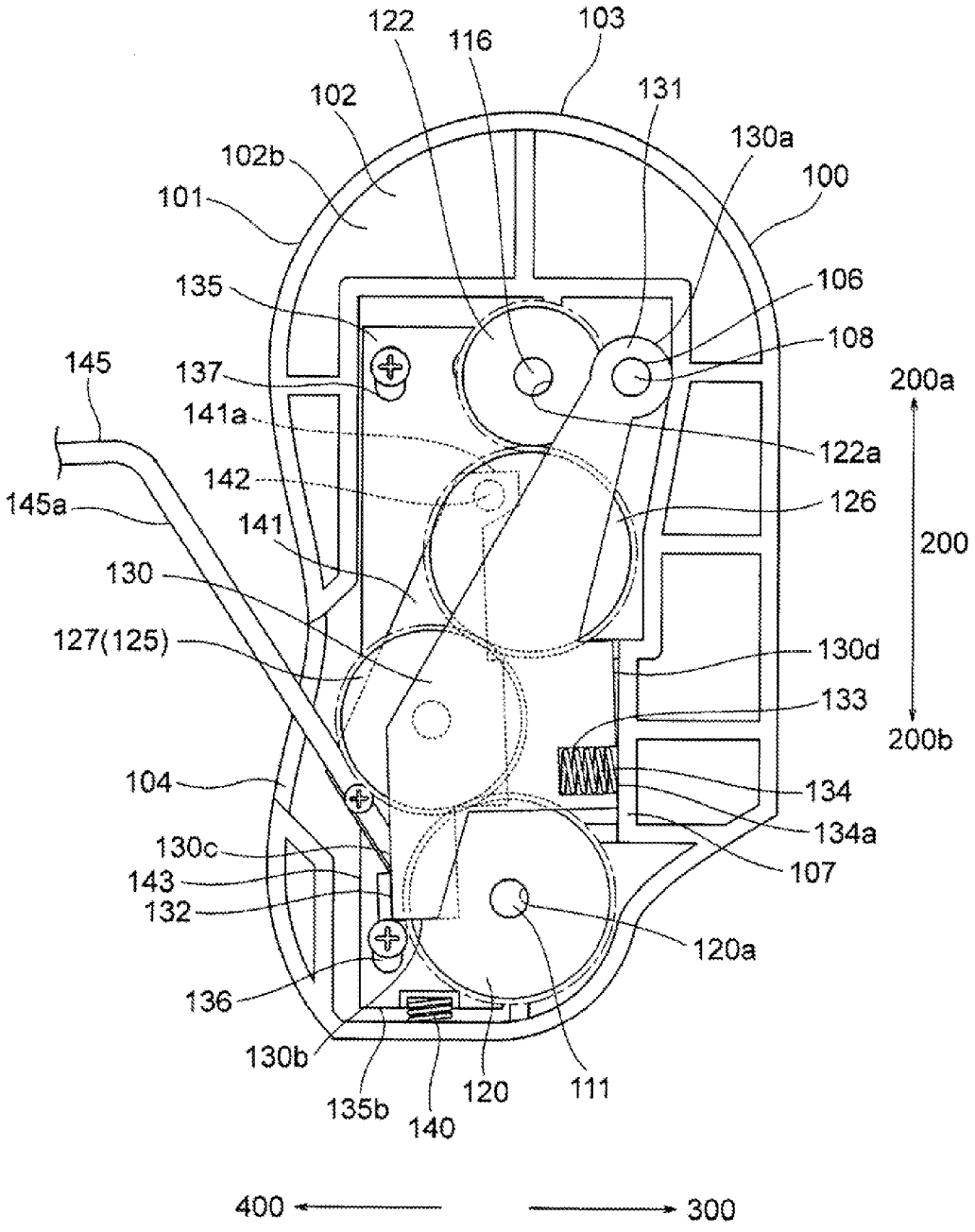
FIG. 11 is a schematic side view showing by broken lines a state in which the grip unit is given a push-down action from the state of FIG. 10 to move a handle base plate and a handle plate downward, rotate the gear retaining plate pressed by a pressing portion of the handle plate forward, and engage the fourth gear and the first gear in a state enabling synchronization of the first gear to the fourth gear.

Then when the adhesive roller unit 110 is pressed onto a contact surface (floor surface) and rotated normally (advanced in the forward direction indicated by arrow 300) by means of the grip unit 145, the rotation of the adhesive roller unit 110 is transmitted through the fourth gear 127 to the third gear 126 and then to the second gear 122 (see FIGS. 11 and 13). As a result, adhesive sheet 110*a* covered with adhered lint and the like is successively wound up on the take-up unit 115.

During reverse movement, i.e., when the adhesive roller unit 110 is rotated in reverse to draw it toward the user (moved backward in the direction of arrow 400), the pressing force that was acting on the adhesive roller unit 110 is released, thereby also releasing the pressing force of the presser 143 on the gear retaining plate 130, so that the gear retaining plate 130 is returned rearward (direction of arrow 400) around the journaling portion 131 by the elastic force of the elastic member 134, thereby separating the fourth gear 127 from the first gear 120 (releasing the engagement). Therefore, the adhesive roller unit 110 is put in a free rotating state (state free to rotate forward or backward) (see FIGS. 8 to 10 and FIG. 12). Hence, load-free operation is possible when pushing/pulling the adhesive roller unit 110 forward or backward.

In the present embodiment, a rotation inhibiting mechanism (first inhibitor 138/second inhibitor 139) is provided that inhibits rotation (normal rotation and reverse rotation) of both the adhesive roller unit 110 and the take-up unit 115 when the adhesive roller unit 110 separates from the contact surface, i.e., when the cleaning tool is lifted up for movement to another location or when cleaning is finished. Therefore, even if the adhesive sheet should inseparably stick to a floor surface, unintentional withdrawal of adhesive sheet is restrained because rotation of both the adhesive roller unit 110 and the take-up unit 115 is inhibited when the cleaning tool is lifted up.

This is because when the cleaning tool is lifted, the case member 100 descends (in the direction of arrow 200*b*) owing to gravitational force, whereupon the first inhibitor 138 and the second inhibitor 139 of the handle base plate 135 inhibit rotation by locking the first meshing portion 121 of the adhesive roller unit rotary shaft 111 and the second meshing portion 123 of the take-up unit rotary shaft 116.

In addition, although not particularly disclosed, similarly to in the first embodiment, a so-called ratchet mechanism can be provided between the second meshing portion 123 and the take-up unit rotary shaft 116, so that when a certain amount of tension occurs during the wind-up operation of the take-up unit 115, the second gear 123 and take-up unit rotary shaft 116 slip (rotate idly).

Other aspects of the configuration and operational effect are the same as those of the first embodiment and explanation thereof is omitted.

The invention claimed is:

1. An adhesive roller-type cleaning tool comprising:

a case member;

an adhesive roller unit deployed inside the case member to be rotatable forward and backward;

a take-up unit to wind up an adhesive sheet drawn out of the adhesive roller unit and having lint adhered thereon;

the take-up unit is configured to rotate forward and backward synchronized through a rotation transmission unit with forward and backward rotation of the adhesive roller unit;

the adhesive roller unit engages the rotation transmission unit in response to the adhesive roller unit being pressed onto a contact surface and a forward movement of the adhesive roller unit, and is energized to release the engagement with the rotation transmission unit in response to a backward movement of the adhesive roller unit and separation of the adhesive roller unit from the contact surface;

a grip unit connected to be rotatable forward and backward with respect to the case member; and a rotation inhibiting mechanism to inhibit rotation of both the adhesive roller unit and the take-up unit in response to separation of the adhesive roller unit from the contact surface, the rotation inhibiting mechanism is synchronized with the forward and rearward rotation of the grip unit to inhibit rotation of the adhesive roller unit and the take-up unit in response to the grip unit being linearly aligned with the case member by the energizing force and to release an inhibiting action in response to the adhesive roller unit being pressed onto a contact surface against the energizing force.

2. An adhesive roller-type cleaning tool according to claim 1, wherein the grip unit is energized to linearly align with the case member and is rotated forward against an energizing force in response to the adhesive roller unit being pressed onto the contact surface.

3. An adhesive roller-type cleaning tool comprising:

an adhesive roller unit deployed to be rotatable forward and backward;

a take-up unit to wind up an adhesive sheet drawn out of the adhesive roller unit and having lint adhered thereon;

the take-up unit is configured to rotate forward and backward synchronized through a rotation transmission unit with forward and backward rotation of the adhesive roller unit;

the adhesive roller unit engages the rotation transmission unit in response to the adhesive roller unit being pressed onto a contact surface and a forward movement of the adhesive roller unit, and is energized to release the engagement with the rotation transmission unit in response to a backward movement of the adhesive roller unit and separation of the adhesive roller unit from the contact surface;

a grip unit;

a rotation inhibiting mechanism to inhibit rotation of both the adhesive roller unit and the take-up unit in response to separation of the adhesive roller unit from the contact surface;

wherein the adhesive roller unit and the take-up unit are each integrally equipped with an engaging unit; and wherein the rotation inhibiting mechanism is equipped with inhibiting units that operate in coordination with push-down/pull-up action of the grip unit to lock with or unlock from the respective engaging units.

4. An adhesive roller-type cleaning tool according claim 3, further comprising a case member provided on an inner face with a handle base plate installed to be vertically moveable;

a handle plate rotatably journaled on the handle base plate at one end and vertically moveable with the handle base plate;

one end of the grip unit is connected to the handle plate;

the adhesive roller unit and the take-up unit are arranged vertically in parallel by an adhesive roller unit rotary shaft and a take-up unit rotary shaft, both projecting outward of the case member;

each of the adhesive roller unit rotary shaft and the take-up unit rotary shaft having one end housed inside the case member;

a first gear and a first engaging unit are integrally provided on the one end of the adhesive roller unit rotary shaft;

a second gear and a second engaging unit are integrally provided on the one end of the take-up unit rotary shaft, the rotation transmission unit constitutes a third gear and a fourth gear deployed inside the case member between the first gear and the second gear;

the third gear is constantly meshed with the second gear;

the fourth gear is rotatably retained on a gear retaining plate whose one end is rotatably journaled on the inner face of the case member, the gear retaining plate is constantly energized to separate the fourth gear from the first gear;

the handle base plate is provided with inhibiting units respectively engageable with the first engaging unit and the second engaging unit; and the handle plate comprising a pressing portion, the pressing portion is effected by a press-down action of the grip unit to press the gear retaining plate and enable the fourth gear to engage with the first gear and the third gear.

* * * * *